US009511898B2

(12) United States Patent
Liao et al.

(10) Patent No.: US 9,511,898 B2
(45) Date of Patent: Dec. 6, 2016

(54) ASSEMBLABLE PALLET

(71) Applicants: AIR-BAG PACKING CO., LTD., New Taipei (TW); Tai-an Liao, New Taipei (TW)

(72) Inventors: Tai-an Liao, New Taipei (TW); Kao-Hsiung Liao, New Taipei (TW); Chieh-Hua Liao, New Taipei (TW)

(73) Assignees: AIR-BAG PACKING CO., LTD., New Taipei (TW); Tai-An Liao, New Taipei (TW)

( * ) Notice: Subject to any disclaimer, the term of this patent is extended or adjusted under 35 U.S.C. 154(b) by 0 days.

(21) Appl. No.: 15/097,944

(22) Filed: Apr. 13, 2016

(65) Prior Publication Data

US 2016/0221714 A1 Aug. 4, 2016

Related U.S. Application Data

(63) Continuation-in-part of application No. 14/804,738, filed on Jul. 21, 2015, now abandoned.

(30) Foreign Application Priority Data

Sep. 15, 2014 (TW) ..... 103131767 A
Apr. 14, 2015 (TW) ..... 104112004 A
Dec. 7, 2015 (TW) ..... 104141001 A

(51) Int. Cl.
*B65D 19/38* (2006.01)
*B65D 19/00* (2006.01)

(52) U.S. Cl.
CPC ..... *B65D 19/0097* (2013.01); *B65D 19/0028* (2013.01); *B65D 2519/00019* (2013.01);
(Continued)

(58) Field of Classification Search
CPC ..... B65D 19/0026; B65D 19/0028; B65D 19/0089; B65D 19/0095; B65D 19/0097; B65D 19/44; B65D 2519/00333; B65D 2519/00298; B65D 2519/00104; B65D 2519/00567; B65D 2519/00129; B65D 2519/00985; B65D 2519/00273; B65D 2519/00323; B65D 2519/00562; B65D 2519/00815
(Continued)

(56) References Cited

U.S. PATENT DOCUMENTS 2,918,190 A * 12/1959 Martin ..... B65D 19/0018 220/4.28
2,955,791 A * 10/1960 George ..... B65D 19/0028 108/57.31
(Continued)

FOREIGN PATENT DOCUMENTS

CN 203359063 U 12/2013
DE 8703808 U1 4/1987
(Continued)

OTHER PUBLICATIONS

Korean Patent Office, Office Action issued on Jul. 25, 2016.
European Patent Office, Office Action issued on Aug. 16, 2016.
European Patent Office, Office Action issued on Aug. 10, 2016.

*Primary Examiner* — Hanh V Tran
(74) *Attorney, Agent, or Firm* — Rabin & Berdo, P.C.

(57) ABSTRACT

An assemblable pallet includes a pallet frame and a loading plate. The pallet frame includes a central member, main members, connecting bars, and slanted connecting bars. The central member includes a body and angled slots formed on the body. The angled slot includes an exterior expanding section, an abutting portion, and an interior expanding section. The main members are located symmetrically about the central member. The main member includes a main body, a main fixing groove and a main angled slot which are formed on the main body. The main angled slot includes an
(Continued)

exterior expanding section, an abutting portion, and an interior expanding section. The connecting bars are held in the main fixing grooves. The slanted connecting bars are held in the main angled slots and the angled slots to position with the central member and the main members. The loading plate is fixed on the pallet frame.

17 Claims, 24 Drawing Sheets

(52) U.S. Cl.
CPC ..... *B65D 2519/00024* (2013.01); *B65D 2519/00029* (2013.01); *B65D 2519/00034* (2013.01); *B65D 2519/00039* (2013.01); *B65D 2519/00044* (2013.01); *B65D 2519/00069* (2013.01); *B65D 2519/00104* (2013.01); *B65D 2519/00129* (2013.01); *B65D 2519/00273* (2013.01); *B65D 2519/00288* (2013.01); *B65D 2519/00293* (2013.01); *B65D 2519/00303* (2013.01); *B65D 2519/00323* (2013.01); *B65D 2519/00338* (2013.01); *B65D 2519/00432* (2013.01); *B65D 2519/00437* (2013.01); *B65D 2519/00562* (2013.01); *B65D 2519/00567* (2013.01); *B65D 2519/00985* (2013.01)

(58) Field of Classification Search
USPC ..... 108/54.1, 56.1, 56.3, 57.19
See application file for complete search history.

(56) References Cited

U.S. PATENT DOCUMENTS 3,981,249 A * 9/1976 Herrmann ..... B65D 19/0095 108/52.1
4,230,050 A * 10/1980 Mays ..... B65D 19/0095 108/57.17
4,869,179 A * 9/1989 Sammons ..... B65D 19/0073 108/56.1
5,404,829 A * 4/1995 Shuert ..... B65D 19/0022 108/57.26
5,413,052 A * 5/1995 Breezer ..... B65D 19/0012 108/56.1
5,544,374 A * 8/1996 Strobel ..... A47C 19/024 108/159
5,636,577 A * 6/1997 Gow ..... B65D 19/0095 108/51.3
5,687,653 A * 11/1997 Bumgarner ..... B65D 19/0091 108/56.3
5,758,855 A * 6/1998 Jordan ..... B65D 19/0026 156/196
5,836,255 A * 11/1998 Uitz ..... B65D 19/0069 108/57.25
6,105,512 A * 8/2000 Lin ..... B65D 19/0073 108/55.5
6,109,190 A * 8/2000 Hale ..... B65D 19/0016 108/57.25
6,199,488 B1 * 3/2001 Favaron ..... B65D 19/0012 108/57.25
6,622,642 B2 * 9/2003 Ohanesian ..... B65D 19/0012 108/53.3
7,661,373 B2 * 2/2010 Apps ..... B65D 19/0012 108/56.3
9,139,334 B2 * 9/2015 Wahl ..... B65D 19/0016
9,150,350 B2 * 10/2015 Stanek ..... B65D 90/24
9,452,864 B2 * 9/2016 Apps ..... B65D 19/0016
2002/0011194 A1 * 1/2002 Lacabanne ..... B65D 19/0085 108/57.19
2002/0112653 A1 * 8/2002 Moore, Jr. ..... B65D 19/0012 108/57.25
2003/0233963 A1 * 12/2003 Fan ..... B65D 19/0012 108/51.11
2004/0216648 A1 * 11/2004 Apps ..... B65D 19/0012 108/57.25
2004/0218276 A1 * 11/2004 Apps ..... B65D 19/0012 359/582
2006/0102055 A1 * 5/2006 Wu ..... B65D 19/0028 108/51.3
2006/0201402 A1 * 9/2006 Moore, Jr. ..... B65D 19/0012 108/57.25
2007/0256614 A1 * 11/2007 Chen ..... B65D 19/0069 108/153.1
2008/0035033 A1 * 2/2008 Liebel ..... B65D 19/0026 108/56.1
2008/0295748 A1 * 12/2008 Yoshida ..... B65D 19/0026 108/55.1
2009/0188412 A1 * 7/2009 Dubois ..... B65D 19/0022 108/57.25
2010/0154685 A1 * 6/2010 Arinstein ..... B65D 19/0018 108/57.16
2011/0303128 A1 * 12/2011 Linares ..... B65D 19/0012 108/51.3
2012/0325125 A1 * 12/2012 Apps ..... B65D 19/0014 108/57.25
2013/0174762 A1 * 7/2013 Hedley ..... B65D 19/0026 108/50.11
2014/0000218 A1 * 1/2014 Kelly ..... B65B 15/00 53/399
2014/0113092 A1 * 4/2014 Doll ..... B65D 19/385 428/36.5

FOREIGN PATENT DOCUMENTS

FR 2681046 A1 3/1993
JP 3065500 U 2/2000
JP 2002002689 A 1/2002
KR 20120133783 A 12/2012

* cited by examiner

ASSEMBLABLE PALLET

CROSS-REFERENCES TO RELATED APPLICATIONS

This application is a continuation-in-part (CIP) of application Ser. No. 14/804,738, filed on 2015 Jul. 21, with claiming foreign priority of TW 103131767. This application claims priority under 35 U.S.C. §119(a) on Patent Application No. 104112004 filed in Taiwan, R.O.C. on 2015 Apr. 14 and Patent Application No. 104141001 file in Taiwan, R.O.C. on 2015 Dec. 7. The prior applications are herewith incorporated by reference in its entirety.

BACKGROUND

Technical Field

The instant disclosure relates to a pallet in which the components of the pallet can be transported by a long distance and assembled in the working place of the pallet, in particular, to an assemblable pallet which can be adjusted according to different uses.

Related Art

In transportation or management of goods, pallets are common tools. The pallets are for loading goods, so that a forklift truck can transport the goods in a convenient manner. In addition to the convenience, the use of the pallet prevents the goods from being damaged or getting wet during transportation or storage.

However, traditional plastic pallets are integrally formed. Molds with different sizes are used to manufacture plastic pallets with different sizes. However, the molds are quite expensive. Furthermore, the traditional plastic pallet might be useless when being damaged, even if only a small piece of the pallet is missing.

SUMMARY

How to manufacture a pallet with low cost and high usage rate is an issue for related personnel.

In view of these, the instant disclosure provides an assemblable pallet. One embodiment of the assemblable pallet comprises a pallet frame and a loading plate. The pallet frame comprises central base member, a plurality of main base members, a plurality of connecting bars, a plurality of slanted connecting bars, and a plurality of T-shaped joint structures formed by the connection between the connecting bars and the standing bars. The connecting bars are made of metal rods like iron, aluminum, or zinc rods, and the base members are made by plastic molding. The central base member comprises a central base body and a plurality of central angled slots formed on the central base body. The central angled slots are arranged symmetrically about a center of the central base body and intersected with each other. Each of the central angled slots comprises, along a direction toward the center of the central base body, a central exterior expanding section, a central abutting portion, and a central interior expanding section. The main base members are located symmetrically about the central base member. Each of the main base members comprises a main base body, a main fixing groove, and a main angled slot. The main fixing groove and the main angled slot are formed on the main base body. Each of the main angled slots comprises, along a direction toward a corner of the corresponding main base body, a main exterior expanding section, a main abutting portion, and a main interior expanding section. The connecting bars are held in the main fixing grooves. Two ends of each of the connecting bars are abutted against inner walls of the corresponding main fixing grooves. The slanted connecting bars are held in the main angled slots and the central angled slots to position with the central base member and the main base members. The slanted connecting bars are positionally restricted by the main angled slots and the central angled slots. The loading plate is fixed on the pallet frame. The connection between the connecting bars and the standing bars can be achieved by soldering procedures. And then, the bars are assembled with the base members to form the pallet frame, and the pallet frame is further assembled with the loading plate to form the assemblable pallet.

Accordingly, the orientation of the connecting bar can be adjusted because of the structures of the main angled slot and the central angled slot. Hence, the main base members and the central base member can be connected with each other by connecting bars with different lengths, so that the distance between each of the main base members and the central base member can be adjusted. Therefore, the length and the width of the assemblable pallet can be adjusted freely according to practical requirements. In addition, the connecting bars can be connected with the standing bars or the vertical connection portion by soldering arts to improve the overall structural strength on crashworthiness. In addition, the connections between the connecting bars, the standing bars, and the connection portions can be achieved by soldering, so that the metal bars form a metal frame, and the base members can be assembled with the metal frame to form the pallet frame. Based on this, because the assembable pallet is formed by the combination of the metal connecting bars, the plastic base members, and the loading plates, for an assemblable pallet with any size, when a main base member or a central base member is impacted to be damaged, the damaged base member can be replaced by a new base member. Hence, the cost for the assembable pallet can be reduced and the usage rate of the assemblable pallet can be improved.

BRIEF DESCRIPTION OF THE DRAWINGS

The disclosure will become more fully understood from the detailed description given herein below for illustration only, and thus not limitative of the disclosure, wherein.

DETAILED DESCRIPTION

Figure 1:
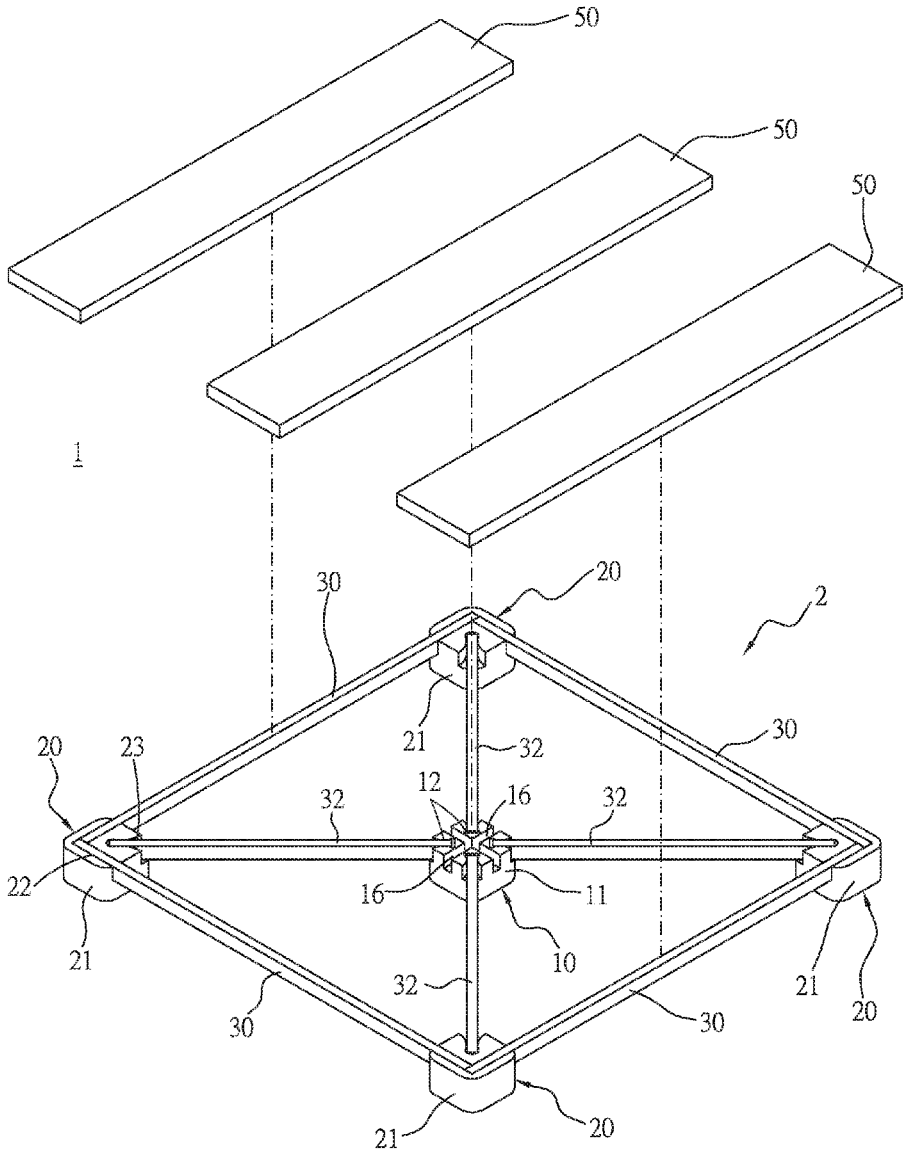
FIG. 1 illustrates an exploded view (1) of an assemblable pallet according to a first embodiment of the instant disclosure.
Figure 2:
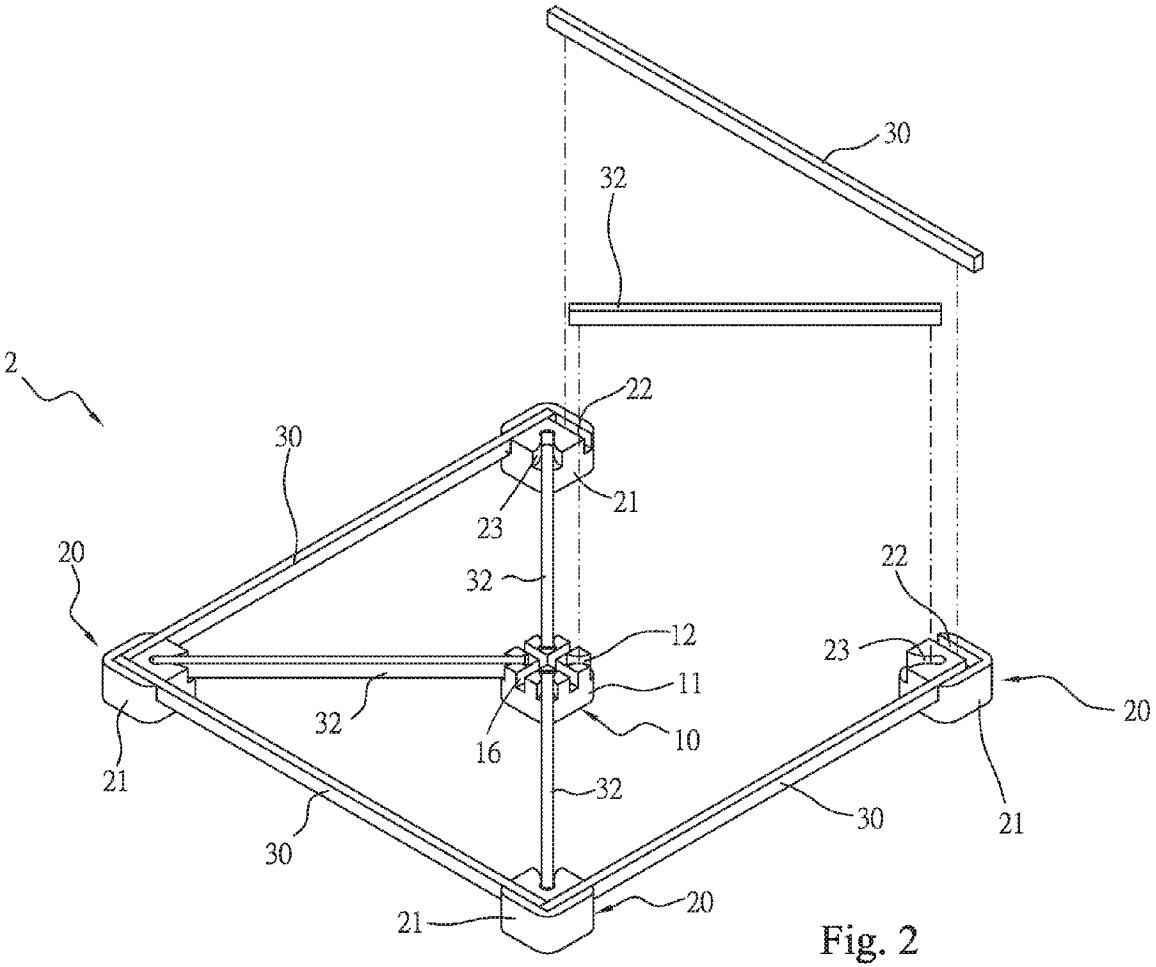
FIG. 2 illustrates an exploded view (2) of the assemblable pallet according to the first embodiment of the instant disclosure.
Figure 3:
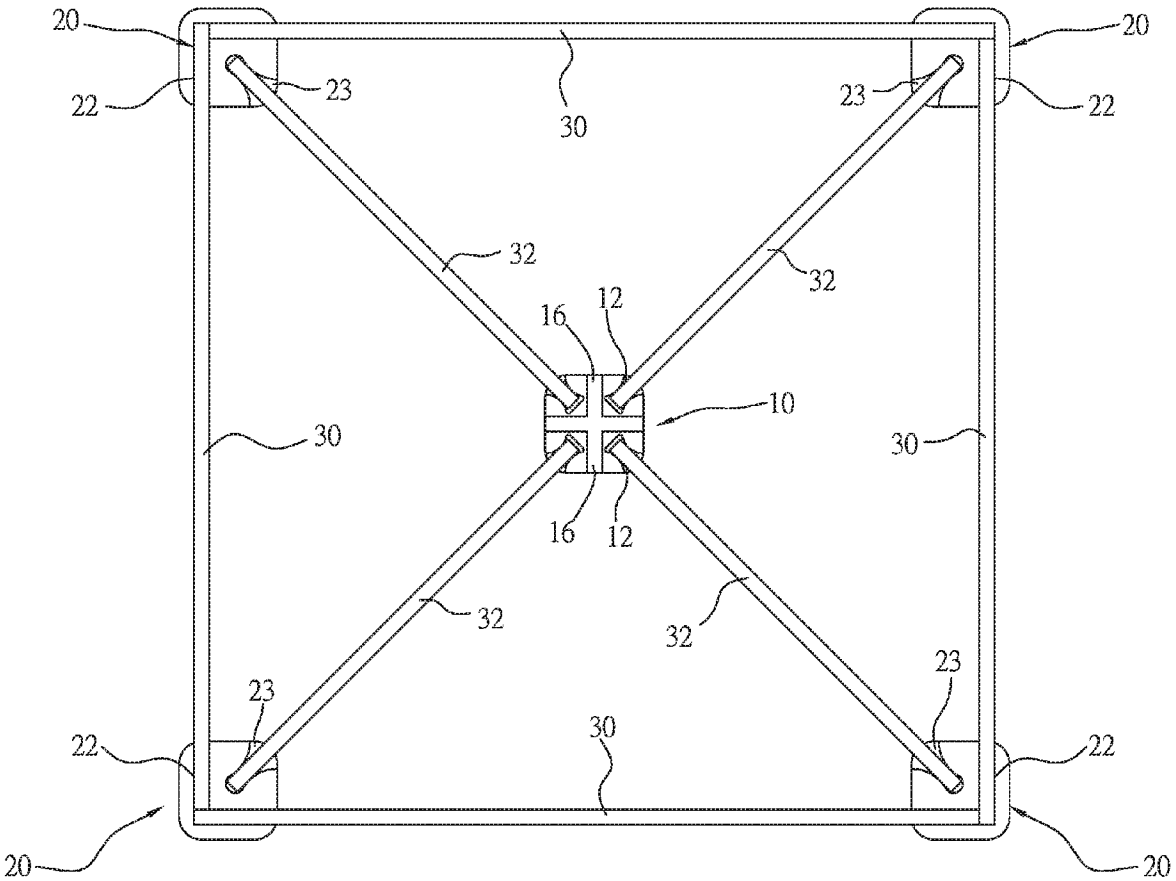
FIG. 3 illustrates a top plan view of the assemblable pallet according to the first embodiment of the instant disclosure.

Please refer to FIGS. 1 to 3, illustrating an assemblable pallet 1 according to a first embodiment of the instant disclosure. FIG. 1 illustrates an exploded view (1), FIG. 2 illustrates an exploded view (2), and FIG. 3 illustrates a top plan view of the assemblable pallet 1 according to the first embodiment of the instant disclosure. The assemblable pallet 1 comprises a pallet frame 2 and a loading plate 50 on the pallet frame 2. The pallet frame 2 comprises a central base member 10 made by plastic molding, a plurality of main base members 20 made by plastic molding, a plurality of connecting bars 30 made of metal, and a plurality of slanted connecting bars 32 made of metal. The connecting bars 30, 32 may be connected with each other to form a metal frame, and the metal frame is further assembled with the base members 10, 20 to form the pallet frame 2.

Figure 8:
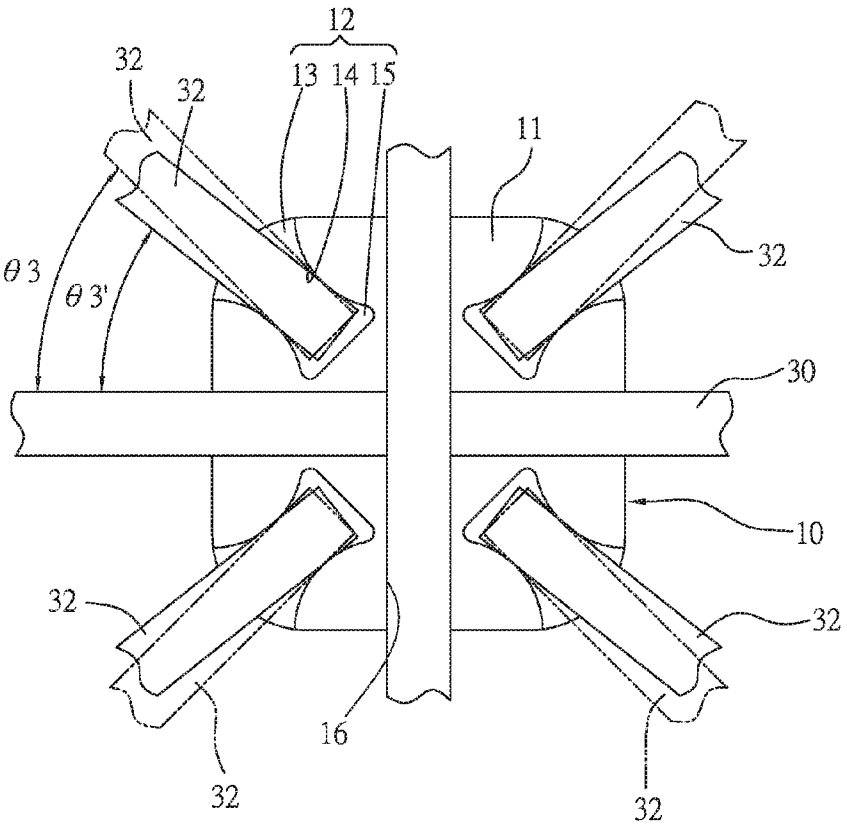
FIG. 8 illustrates a schematic top plan view showing the central base member of the assemblable pallet.

Please further refer to FIG. 8. The central base member 10 may be manufactured by plastic extrusion molding. The central base member 10 comprises a central base body 11 and a plurality of central angled slots 12 formed on the central base body 11. The central angled slots 12 are arranged symmetrically about a center of the central base body 11 and intersected with each other. Each of the central angled slots 12 comprises, along a direction toward the center of the central base body 11, a central exterior expanding section 13, a central abutting portion 14, and a central interior expanding section 15. In this embodiment, the central base body 11 may be, but not limited to, a polyhedron, such as a cube (as shown in FIG. 1) or a cuboid. Alternatively, the central base body 11 may be of round, oblong, or irregular shape. The central angled slots 12 are recessed from the top surface of the central base body 11. In this embodiment, the central base member 10 comprises four central angled slots 12 respectively located at four corners of the central base body 11. Each of the central angled slots 12 is extending toward the center of the central base body 11 and does not communicate with other central angled slots 12. From a top view, each of the central angled slots 12 is of funnel shape (or of gourd shape). In other words, the central abutting portion 14 of each of the central angled slots 12 is the neck portion of the slot, i.e., the width of the central abutting portion 14 is less than the width of the central interior expanding section 15 and the width of the central exterior expanding section 13. The width of the central interior expanding section 15 may be equal to or less than the width of the central exterior expanding section 13. In addition, the central exterior expanding section 13 is opened, so that a connecting bar can be inserted into the central angled slot 12 from the central exterior expanding section 13.

Figure 7A:
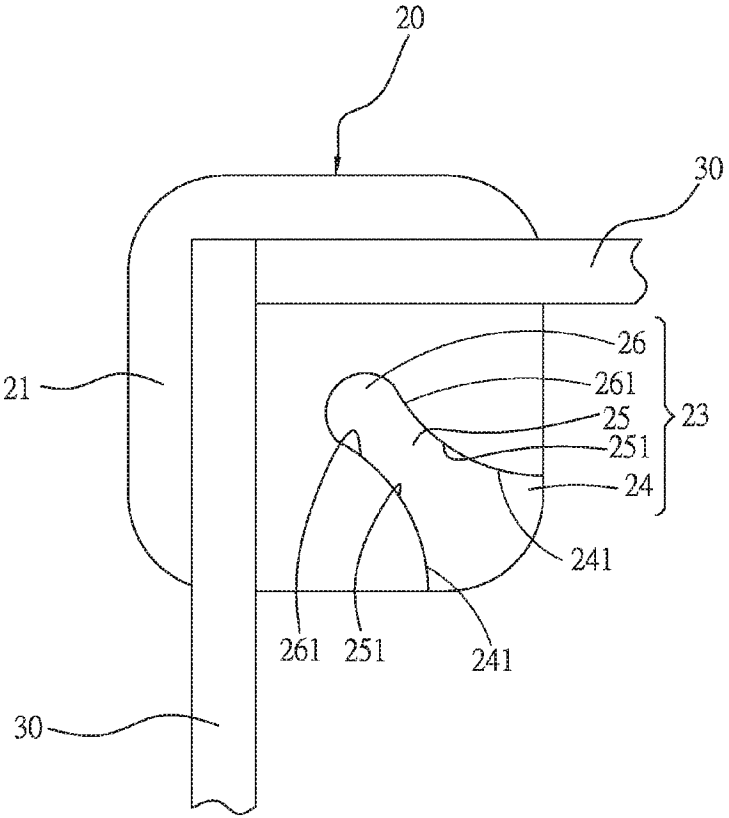
FIG. 7A illustrates a schematic top plan view (1) showing the main base member of the assemblable pallet.

Please refer to FIGS. 1, 2, and 7A. The main base members 20 are located symmetrically about the central base member 10. Each of the main base members 20 comprises a main base body 21, a main fixing groove 22, and a main angled slot 23. The main fixing groove 22 and the main angled slot 23 are formed on the main base body 21. Each of the main angled slots 23 comprises, along a direction toward a corner of the main base body 21, a main exterior expanding section 24, a main abutting portion 25, and a main interior expanding section 26. In this embodiment, the main base members 20 are located at the periphery of the central base member 10 and respectively correspond to the corners of the central base member 10. Hence, the main base members 20 are arranged as a 2×2 matrix structure, and the orientations of the main base members 20 are aligned with the orientation of the central base members 10. The main base bodies 21 may be, but not limited to, polyhedrons, such as cubes or cuboids. Alternatively, the main base bodies 21 may be of round, oblong, or irregular shape. The main fixing groove 22 is of right-angle shape and located at the side portions of the top surface of the main base body 21. In other words, the main fixing groove 22 is of L shape, and the corner of the main fixing groove 22 corresponds to the corner of the main base member 20. The main angled slot 23 is also recessed from the top surface of the main base body 21 and located at a corner of the main base body 21 closed to the central base member 10. In addition, each of the central angled slots 12 and the corresponding main angled slot 23 are extending along the same line. From a top view, each of the main angled slots 23 is of funnel shape (or of gourd shape). In other words, the main abutting portion 25 of each of the main angled slots 23 is the neck portion of the slot, i.e., the width of the main abutting portion 25 is less than the width of the main interior expanding section 26 and the width of the main exterior expanding section 24. The width of the main interior expanding section 26 may be equal to or less than the width of the main exterior expanding section 24. In addition, the main exterior expanding section 24 is opened, and the opening of the main exterior expanding section 24 corresponds to the opening of the central exterior expanding section 13. Accordingly, a connecting bar can be inserted into the main angled slot 23 from the main exterior expanding section 24.

In detail, the main exterior expanding section 24 comprises two exterior arc surfaces 241 at two sides thereof (that is, the main exterior expanding section 24 is formed between the two exterior arc surfaces 241). The two exterior arc surfaces 241 are extending away from the corner of the pallet frame 1, so that the main exterior expanding section 24 is of fan shape. The main abutting portion 25 comprises two abutting surfaces 251. The main interior expanding section 26 comprises two interior arc surfaces 261 at two sides thereof (that is, the main interior expanding section 26 is formed between the two interior arc surfaces 261), and the two interior arc surfaces 261 are extending toward the center of the main base member 20. The exterior arc surface 241, the abutting surface 251, and the interior arc surface 261 at the same side form a convex arc surface. Hence, from a top view, the main angled slot 23 is of gourd shape. The curvature of the exterior arc surface 241 and the curvature of the interior arc surface 261 may be the same. Alternatively, the distance between the two exterior arc surfaces 241 may be greater than the distance between the two interior arc surfaces 261. In other words, the curvature of the interior arc surface 261 may be less than the curvature of the exterior arc surface 241. In addition, one of two ends of each of the interior arc surfaces 261 is joined to the abutting surface 251, and the other ends of the two interior arc surfaces 261 are joined with each other to define an abutting end. The structure of the main angled slot 23 may be the same as that of the central angled slot 12, repeated detail is omitted.

Please refer to FIGS. 1 to 3. The connecting bars 30 are held in the main fixing grooves 22 of the main base members 20. Two ends of each of the connecting bars 30 are abutted against respective inner walls of the main fixing grooves 22 of two main base members 20. Hence, the main base members 20 can be fixed by the connecting bars 30. In this embodiment, the connecting bar 30 is an elongate bar, and the diameter of the connecting bar 30 is not greater than the width of the main fixing groove 22, so that the connecting bar 30 can be engaged into the main fixing groove 22 and positioned at the corner of the main fixing groove 22. For example, when two adjacent ends of two connecting bars 30 are held in a single main fixing groove 22, the first adjacent end of one connecting bar 30 is firstly leaned against the inner wall of the corner of the main fixing groove 22, and then, the second adjacent end of the other connecting bar 30 is further leaned against the surface of the first adjacent end of the connecting bar 30. Accordingly, the main base members 20 can be positioned by the connecting bars 30.

Please refer to FIGS. 1 to 3. The slanted connecting bars 32 are held in the main angled slots 23 of the main base members 20 and the central angled slots 12 of the central base member 10 to position with the central base member 10 and the main base members 20. The slanted connecting bars 32 are positionally restricted by the main angled slots 23 and the central angled slots 12. In this embodiment, the slanted connecting bar 32 is an elongate bar, and the diameter of the slanted connecting bar 32 is not greater than the minimum width of the main angled slot 23 and the minimum width of the central angled slot 12. In other words, two ends of the slanted connecting bar 32 are respectively inserted into the main angled slot 23 and the central angled slot 12 and respectively located at the main interior expanding section 26 and the central interior expanding section 15. Therefore, the two ends of the slanted connecting bar 32 can respectively abut against the interior arc surfaces 261 of the main interior expanding section 26 and the arc surfaces of the central interior expanding section 15. Hence, the slanted connecting bars 32 position with the central base member 10 and the main base members 20. It is understood that, after the connecting bars 30 and the slanted connecting bars 32 are engaged into the main fixing grooves 22, the main angled slots 23, and the central angled slots 12, a gluing procedure or a soldering procedure may be further applied thereto to improve the fixation between the connecting bars 30, the slanted connecting bars 32, the central base member 10, and the main base members 20.

Figure 9:
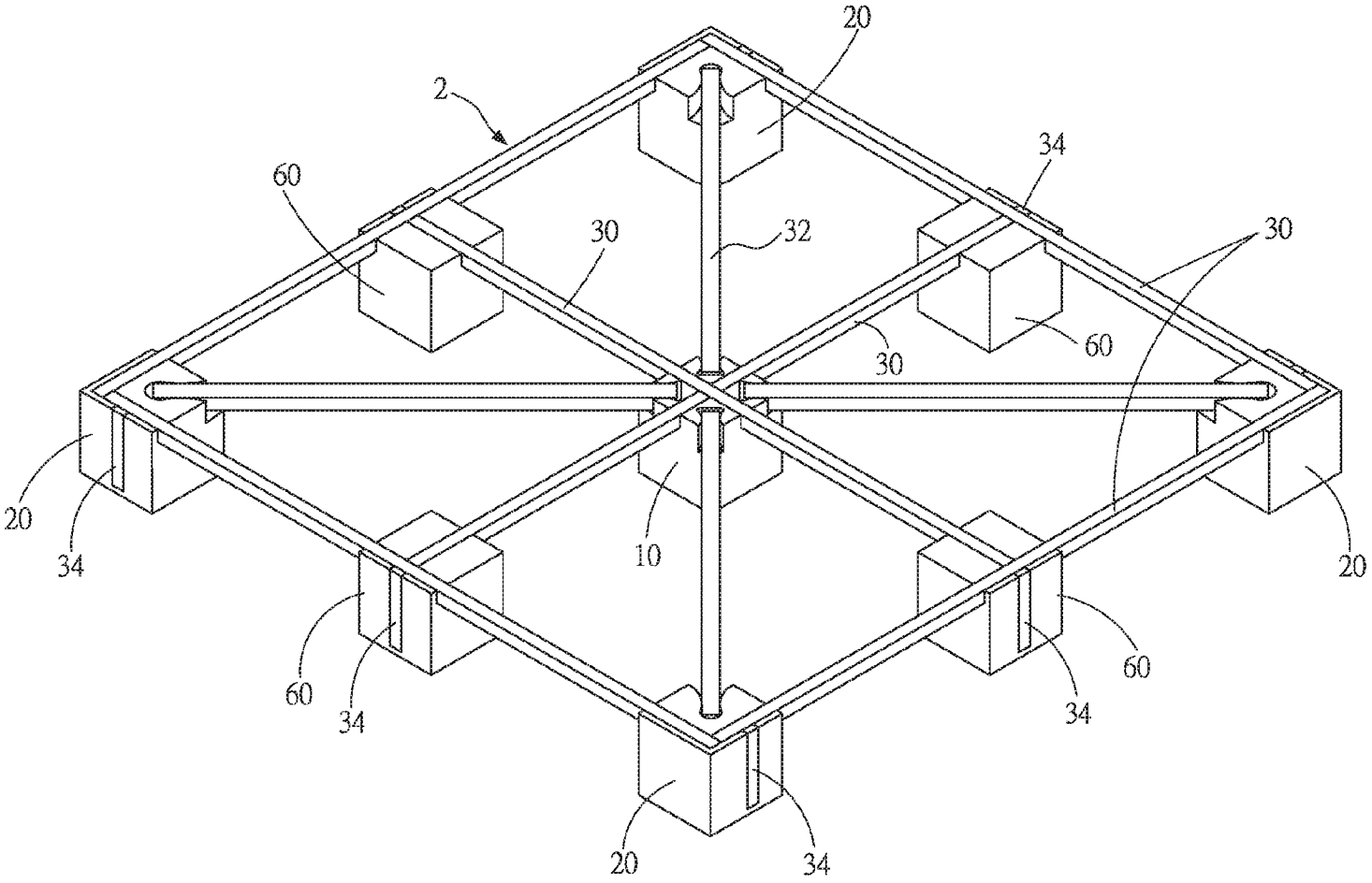
FIG. 9 illustrates a perspective view of an assemblable pallet according to a third embodiment of the instant disclosure.

Accordingly, as shown in FIG. 1, the central base member 10 and the main base members 20 are positioned with the connecting bars 30 and the slanted connecting bars 32 to form the pallet frame 2. And then, the loading plate 50 is fixed on the pallet frame 2 to form the assemblable pallet 1. In this embodiment, the loading plate 50 comprises several small sized plates, but embodiments are not limited thereto. In some embodiments, the loading plate 50 may be a big sized plate. Hence, the loading plate 50 is spaced from the ground by a distance, so that the lifting portions of forklift trucks or other pallet carrying machines can be inserted into the space between the loading plate 50 and the ground to move the assemblable pallet 1 for goods transportation or management. The loading plate 50 may be a wooden board, a plastic board, a paper honeycomb plate, or a composite board. Moreover, the loading plate 50 may be fixed on the pallet frame 2 by means of engaging, mating, gluing (as shown in FIG. 9), locking, or heat sealing to form the assemblable pallet 1. In addition, after the loading plate 50 is fixed on the pallet frame 2, the loading plate 50 presses on the connecting bars 30 and the slanted connecting bars 32, so that the connecting bars 30 and the slanted connecting bars 32 would not detached from the central base member 10 and the main base members 20. Moreover, the connecting bars 30, 32 can be connected with each other to form a rigid structure (i.e., the metal frame) by soldering. In addition, the connection between the connecting bars 30, 32, the standing bars 34, and the vertical connection portions 30A, 32A can also be achieved by soldering.

Figure 4:
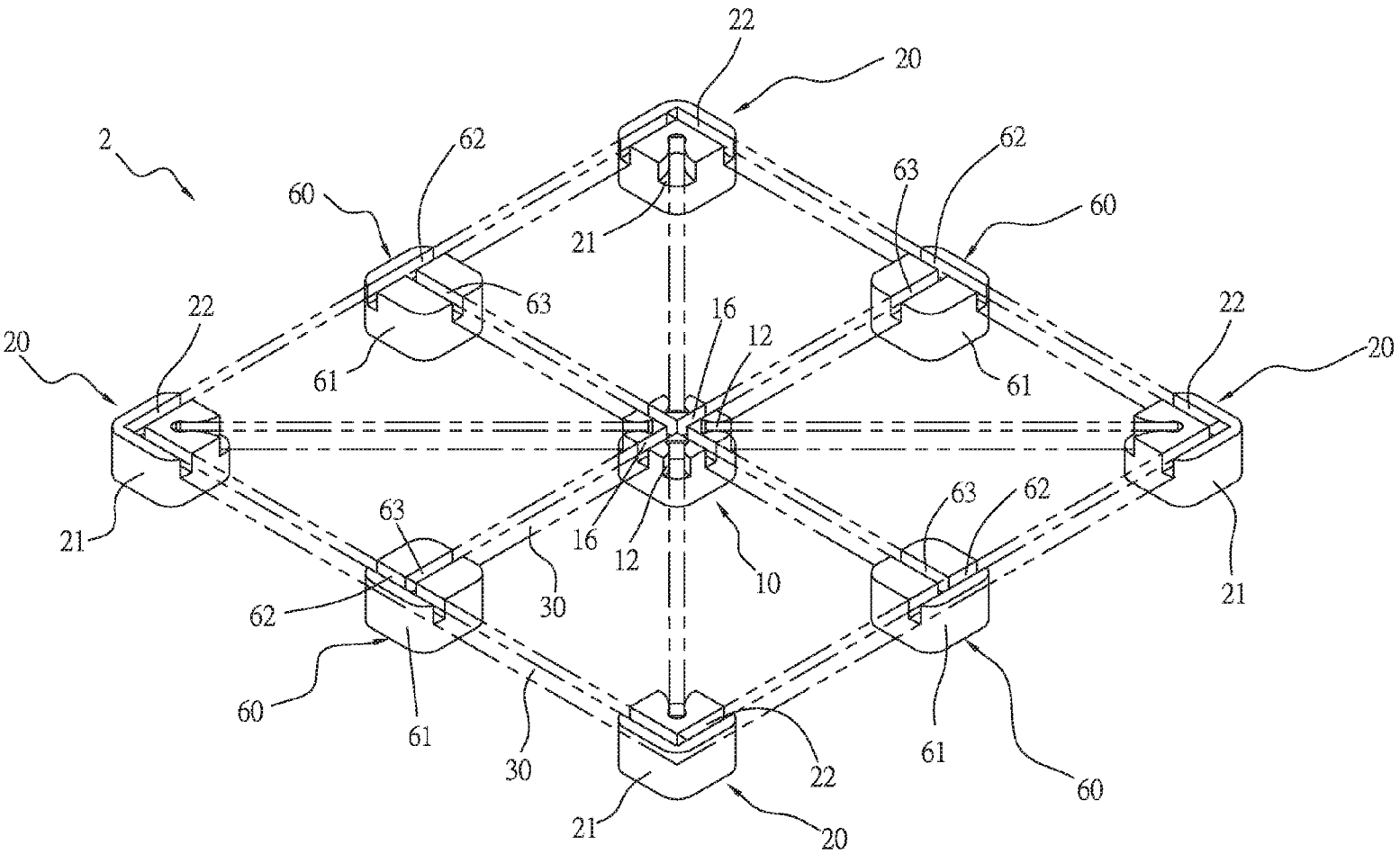
FIG. 4 illustrates a schematic perspective view of an assembable pallet according to a second embodiment of the instant disclosure.
Figure 5:
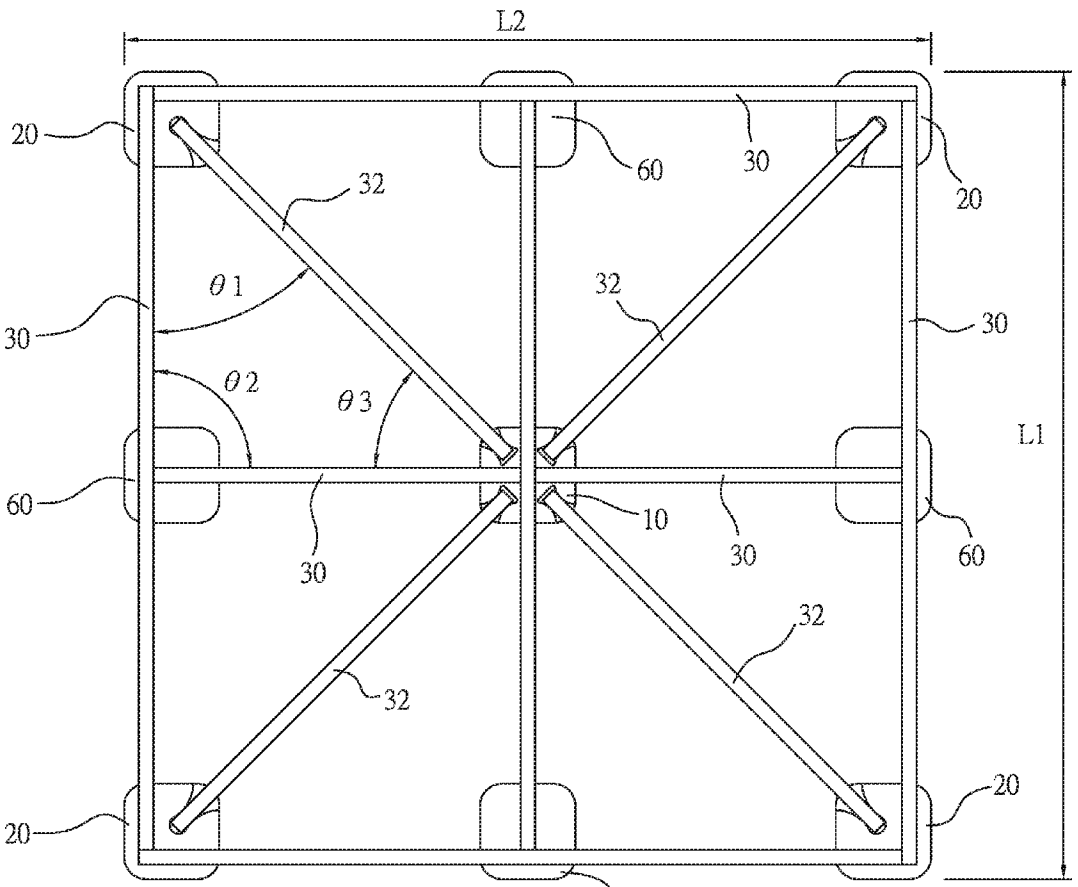
FIG. 5 illustrates a top plan view of the assemblable pallet according to the second embodiment of the instant disclosure.

FIGS. 4 and 5 are respectively a schematic perspective view and a top plan of an assemblable pallet 1 according to a second embodiment of the instant disclosure. In the second embodiment, the assemblable pallet 1 further comprises a plurality of side base members 60 respectively located at the periphery of the central base member 10 and between the main base members 20. Each of the side base members 60 comprises a side base body 61, a side fixing groove 62, and a side slot 63. The side fixing groove 62 and the side slot 63 are formed on the side base body 61. The central base member 10 comprises a plurality of central slots 16 intersected with the central angled slots 12. The connecting bars 30 are further held in the side fixing grooves 62, the side slots 63, and the central slots 16. In this embodiment, the side base members 60 are respectively surrounding the central base member 10 and between each two of the main base members 20. Therefore, the central base member 10, the main base members 20, and the side base members 60 are arranged as a 3×3 matrix structure. In some embodiments, several side base members 60 may be, but not limited to, located between each two of the main base members 20, and the base members 10, 20, 60 are arranged as a 4×4 matrix structure or a 5×5 matrix structure. The side base bodies 61 may be, but not limited to, polyhedrons, such as cubes or cuboids. Alternatively, the side base bodies 61 may be of round, oblong, or irregular shape. The side fixing groove 62 and the side slot 63 are recessed from the side base body 61 and substantially perpendicular with each other (in this embodiment, the side fixing groove 62 and the side slot 63 are of T shape). The side fixing groove 62 of each of the side base members 60 and the main fixing grooves 22 of the corresponding main base members 20 are substantially extending along the same line, and the side slot 63 of each of the side base members 60 and the corresponding central slot 16 of the central base member 10 are substantially extending along the same line. In addition, the central slots 16 are in communication with each other. The central slots 16 are defined through the center of the central base member 10 to form a cross-like pattern. Moreover, the central slots 16 and the central angled slots 12 are intersected with each other to form a star-like pattern. The connecting bars 30 are further held in the side fixing grooves 62, the side slots 63, and the central slots 16 to position with the side base members 60 and the central base member 10. Accordingly, the overall structural strength of the assemblable pallet 1 can be further improved.

Additionally, the central base member 10, the main base members 20 and the side base members 60 may be hollowed, so that the assembable pallet 1 can be light weight and the cost of the assemblable pallet 1 can be reduced.

Based on the above, because of the structures of the main angled slots 23 and the structure of the central angled slots 12, the angles of the connecting bars 30 and the slanted connecting bars 32 can be adjusted easily, so that the assemblable pallet can have different sizes; details are described as following.

Figure 6:
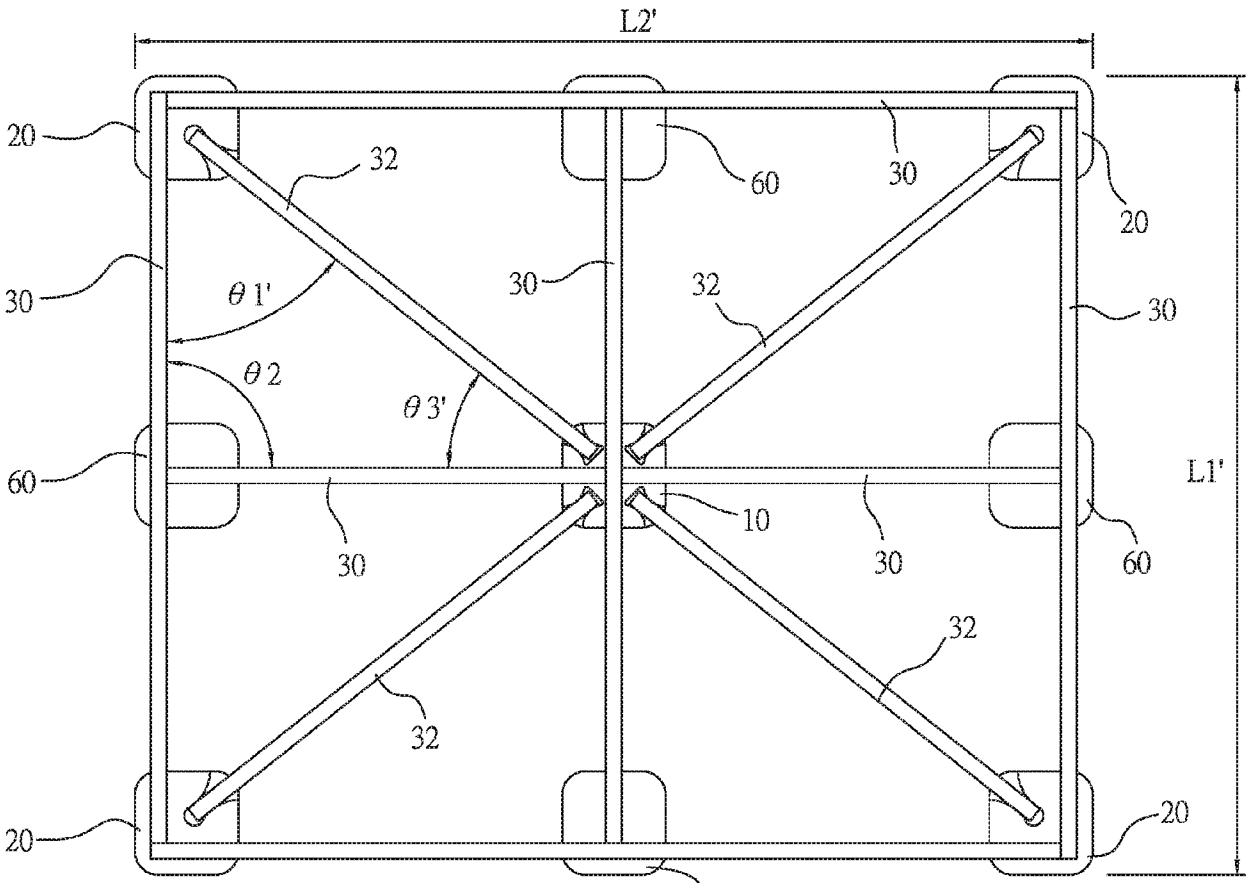
FIG. 6 illustrates a top plan view of the assemblable pallet having another size according to the second embodiment of the instant disclosure.

Please refer to FIG. 5. In this embodiment, the length L1 of the assemblable pallet 1 (i.e., the distance between opposite outer lateral surfaces of two main base members 20 along the vertical direction) is equal to the width L2 of the assemblable pallet 1 (i.e., the distance between opposite outer lateral surfaces of two main base members 20 along the horizontal direction). For example, the length L1 of the assemblable pallet 1 and the width L2 of the assembable pallet 1 is 1100 cm (centimeter), and the angles between each of the slanted connecting bars 32 and the adjacent two connecting bars 30 are respectively 45 degrees (θ 1), 90 degrees (θ 2), and 45 degrees (θ 3). Hence, the two ends of each of the slanted connecting bars 32 are respectively abut against the main abutting portion 25 of the corresponding main base member 20 and the corresponding central abutting portion 14 of the central base member 10. As shown in FIGS. 6 to 8, if the length L1' of the assemblable pallet 1 (the distance between opposite outer lateral surfaces of two main base members 20 along the vertical direction) is 1000 cm, and the width L2' of the assemblable pallet 1 (the distance between opposite outer lateral surfaces of two main base members 20 along the horizontal direction) is 1200 cm, the angles between each of the slanted connecting bars 32 and the adjacent two connecting bars 30 are respectively 52 degrees (θ 1'), 90 degrees (θ 2), and 38 degrees (θ 3'). Although the angles (θ 1, θ 3) of the assemblable pallet 1 shown in FIG. 5 is different from the angles (θ 1', θ 3') of the assemblable pallet 1 shown in FIG. 6, the two ends of each of the slanted connecting bars 32 can be abutted against the main abutting portion 25 of the corresponding main base member 20 and the corresponding central abutting portion 14 of the central base member 10. In other words, because of the structures of the central exterior expanding section 13, the central interior expanding sections 14, the main exterior expanding section 24, and the main interior expanding section 26, after the angles between the connecting bars 30 and the slanted connecting bars 32 are changed, one of two ends of each of the slanted connecting bars 32 is still abutted against the corresponding central abutting portion 14 of the central base member 10, and the other end of the slanted connecting bar 32 is still abutted against the main abutting portion 25 of the corresponding main base member 20.

To allow the assemblable pallet 1 to have different sizes, the angle θ 1 and the angle θ 1' are respectively 45 degrees and 52 degrees, but embodiments are not limited thereto. In some embodiments, the length and the width of the assemblable pallet may be changed according to practical requirements. For example, when the length of the assembable pallet 1 is 1100 cm and the width of the assemblable pallet 1 is 1200 cm, the angles between the each of the slanted connecting bars 32 and the adjacent two connecting bars 30 are respectively 48 degrees (θ 1), 90 degrees (θ 2), and 42 degrees (θ 3). In another example, when the length is 1000 cm and the width is 1100 cm, the angles between the each of the slanted connecting bars 32 and the adjacent two connecting bars 30 are respectively 49 degrees (θ 1), 90 degrees (θ 2), and 41 degrees (θ 3). In the forgoing two examples, the angles θ 1 are 48 degrees and 49 degrees which are within the interval between 45 degrees and 52 degrees. Hence, in the forgoing two examples, the two ends of each of the slanted connecting bars 32 are respectively abutted against the corresponding main abutting portion 25 and the corresponding central abutting portion 14. In addition, the angles between the two ends of each of the slanted connecting bars 32 and the corresponding central exterior expanding section 13, the corresponding central interior expanding section 15, the corresponding main exterior expanding section 24, and the corresponding main interior expanding section 26 can be changed. Therefore, the structures of the central angled slots 12 and the main angled slots 23 allow the angles between each of the slanted connecting bars 32 and the two adjacent connecting bars 30 to be different.

Figure 7B:
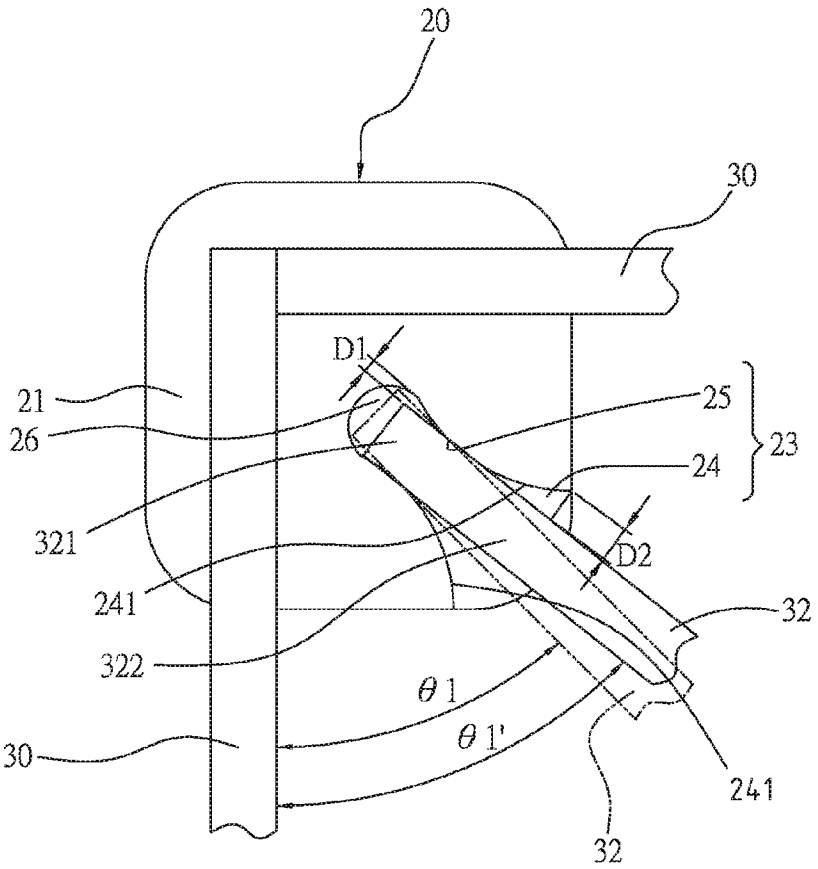
FIG. 7B illustrates a schematic top plan view (2) showing the main base member of the assemblable pallet.

Please refer to FIG. 7B. The received portion of each of the slanted connecting bars 32 (i.e., the portion of the slanted connecting bar 32 received in the corresponding main angled slot 23) may be further divided into a terminal portion 321 and a middle portion 322 by taking the main abutting portion 25 as a dividing point. The terminal portion 321 is received in the corresponding main interior expanding section 26, and the middle portion 322 is received in the corresponding main exterior expanding section 24. Hence, the received portion of the slanted connecting bar 32 can deflect by using a bearing portion of the slanted connecting bar 32 (i.e., the portion of the slanted connecting bar 32 which is abutted against the main abutting portion 25), so that the orientation of the terminal portion 321 in the main interior expanding section 26 can be adjusted, and the orientation of the middle portion 322 would be opposite to the orientation of the terminal portion 321. Therefore, for the interior arc surface 261 and the exterior arc surface 241 at the same side, the projection distance D1 from the end portion of the interior arc surface 261 to the corresponding slanted connecting bar 32 is inversely proportional to the projection distance D2 from the end portion of the exterior arc surface 241 to the same slanted connecting bar 32. Accordingly, the orientation of the slanted connecting bar 32 can be adjusted to form assemblable pallets 1 having different sizes.

In addition, as shown in FIGS. 7A and 7B, in this embodiment, the distance between the two exterior arc surfaces 241 is greater than the distance between the two interior arc surfaces 261. Hence, when the orientation of the received portion of the slanted connecting bar 32 is adjusted, the received portion of the slanted connecting bar 32 can not only abut against the abutting surfaces 251 of the main abutting portion 25 but also the interior arc surfaces 261. Therefore, the abutted area of the received portion of the slanted connecting bar 32 can increase, and the fixation between the slanted connecting bar 32 and the main base member 20 can be improved. In some embodiments, the curvature of the exterior arc surface 241 is the same as the curvature of the interior arc surface 261 (similar to the structure of the central angled slot 12). Accordingly, when the orientation of the received portion of the slanted connecting bar 32 is adjusted, the received portion of the slanted connecting bar 32 can not only abut against the abutting surface 251 of the main abutting portion 25, but also the exterior arc surface 241 and the interior arc surface 261. Thus, the fixation between the slanted connecting bar 32 and the corresponding main base member 20 can be improved.

Figure 10:
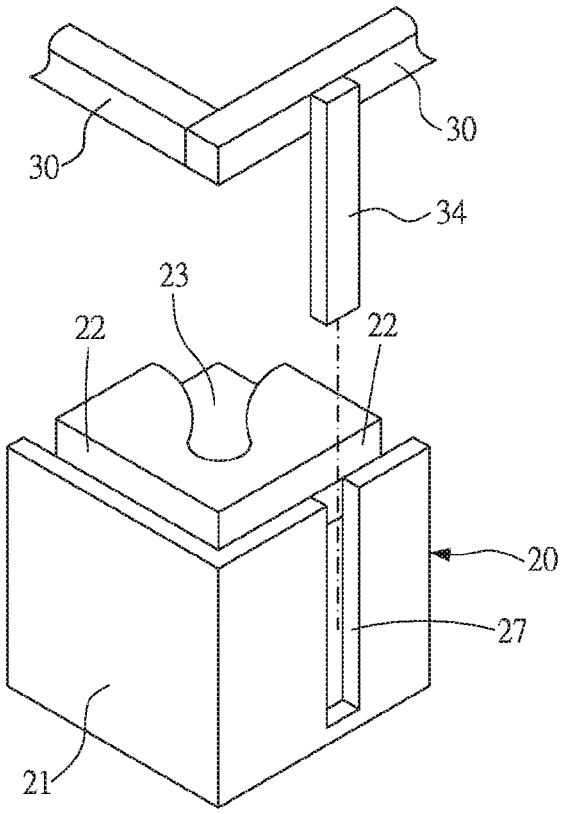
FIG. 10 illustrates an exploded view of the main base member and the connecting bar of the third embodiment.
Figure 11:
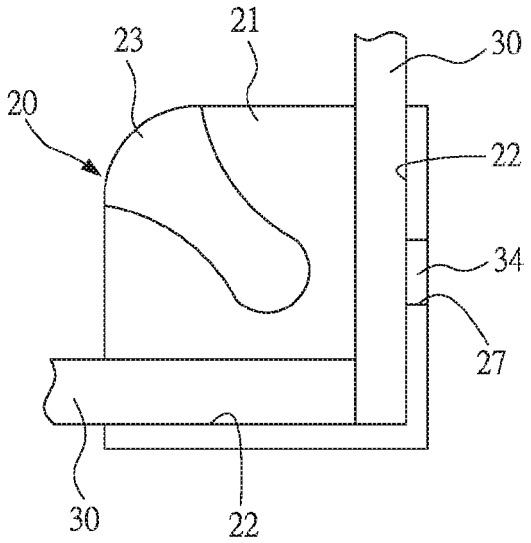
FIG. 11 illustrates an assembled top view of the main base member and the connecting bar of the third embodiment.
Figure 12:
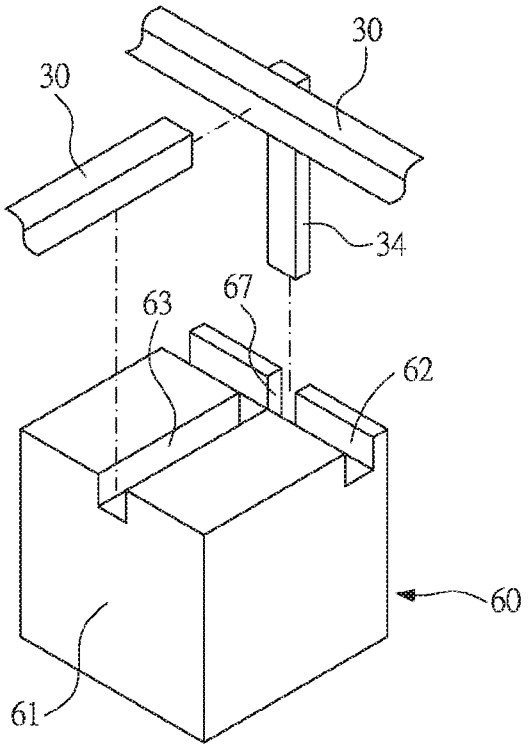
FIG. 12 illustrates an exploded view of the side base member and the connecting bar of the third embodiment.
Figure 13:
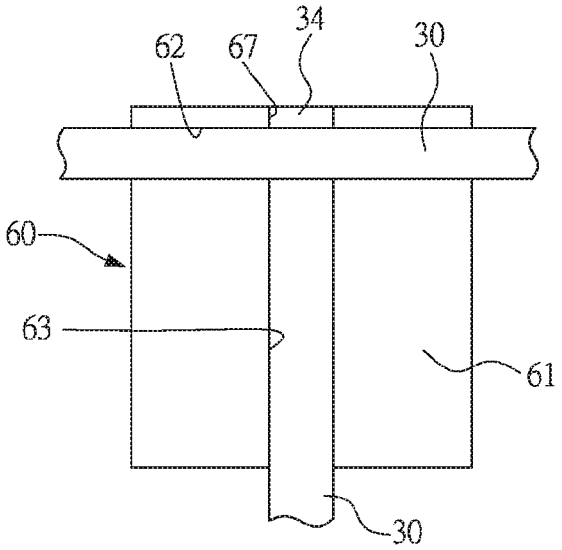
FIG. 13 illustrates an assembled top view of the side base member and the connecting bar of the third embodiment.
Figure 14:
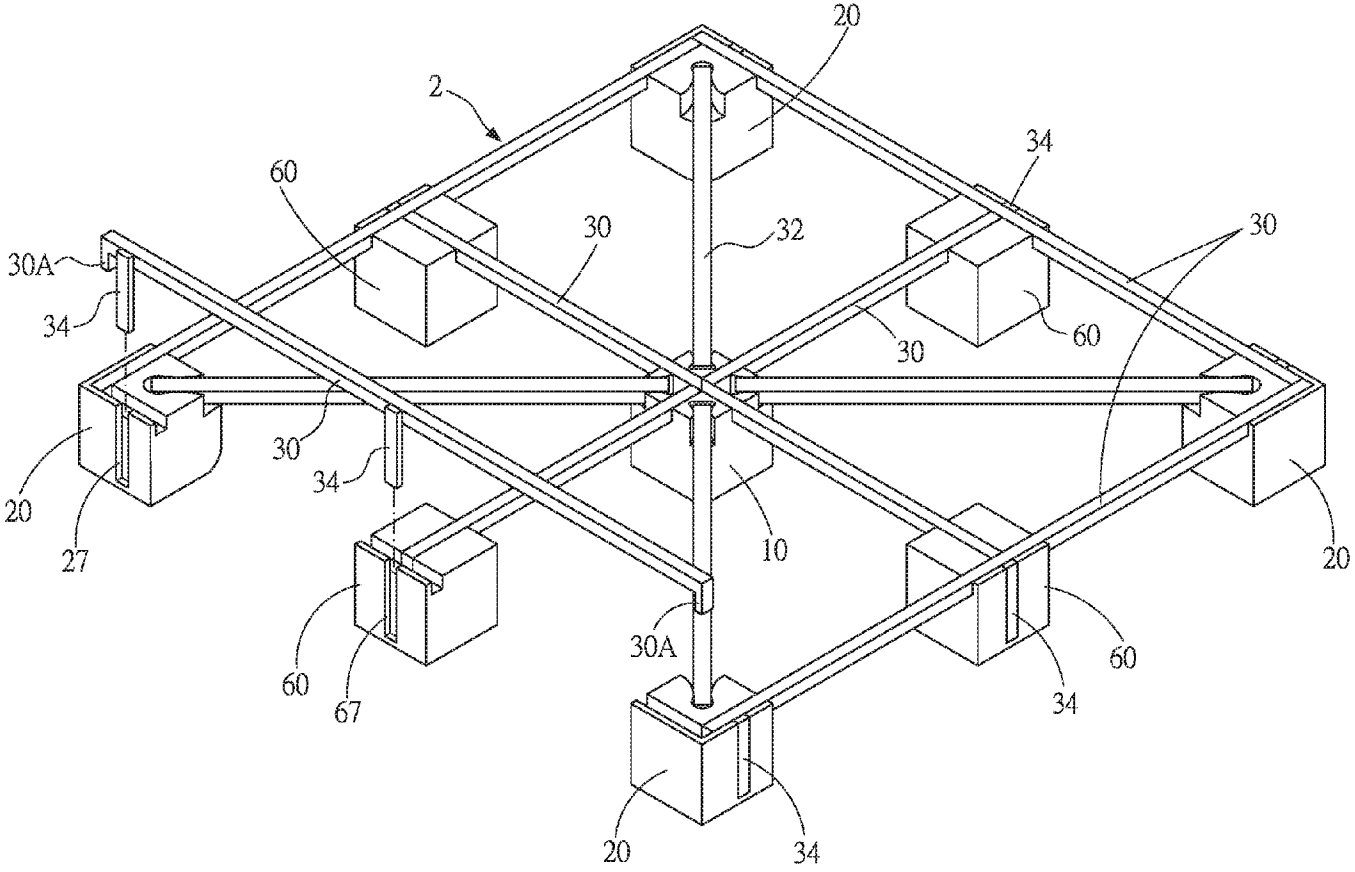
FIG. 14 illustrates a perspective view of an assemblable pallet according to a fourth embodiment of the instant disclosure.
Figure 15:
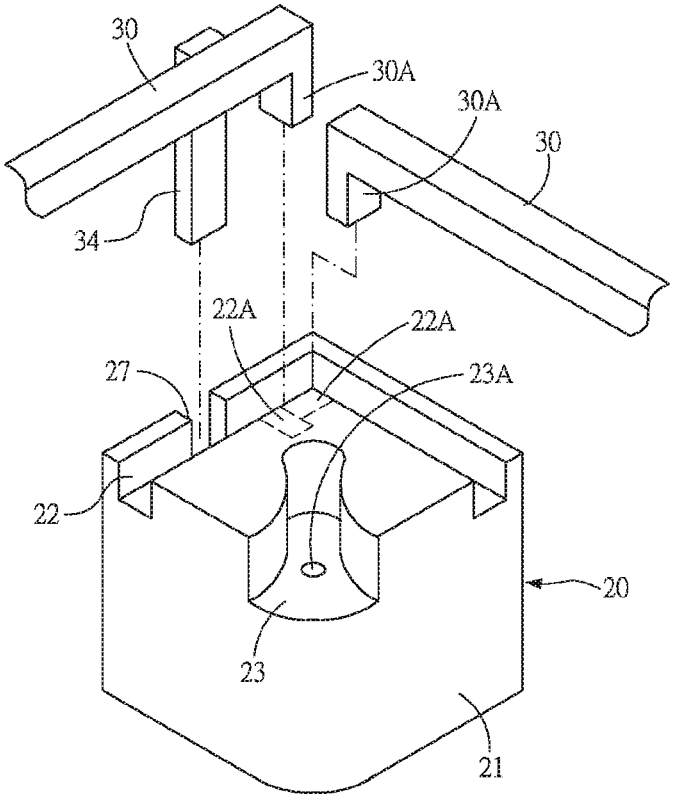
FIG. 15 illustrates an exploded view of the main base member and the connecting bar of the fourth embodiment.
Figure 16:
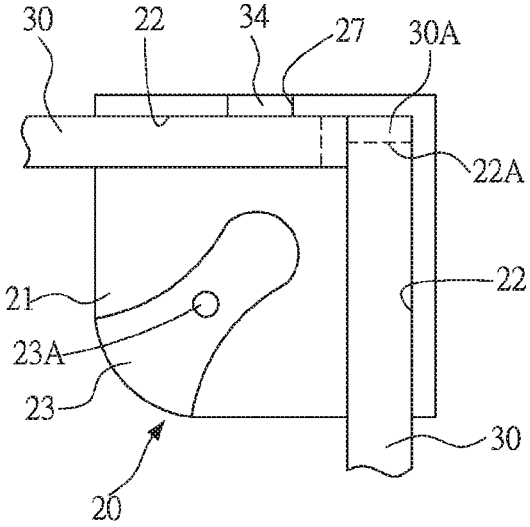
FIG. 16 illustrates an assembled top view of the main base member and the connecting bar of the fourth embodiment.
Figure 17:
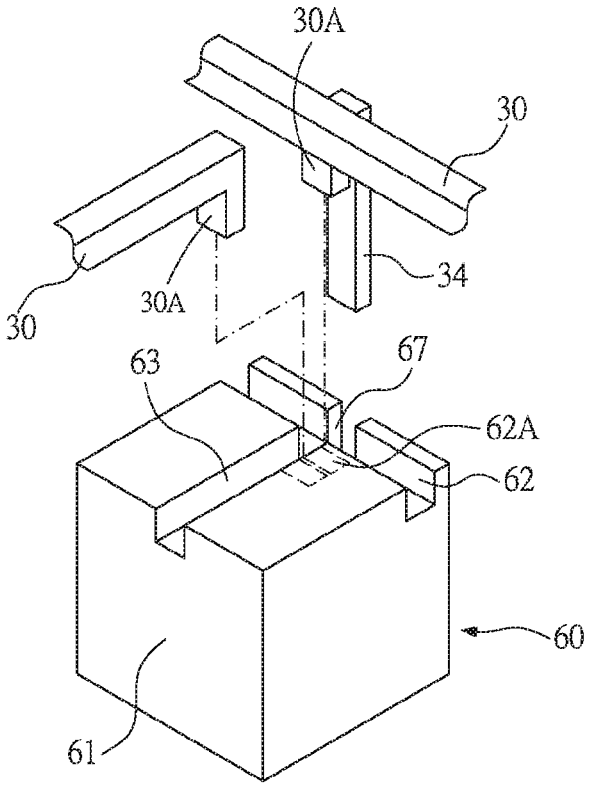
FIG. 17 illustrates an exploded view of the side base member and the connecting bar of the fourth embodiment.
Figure 18:
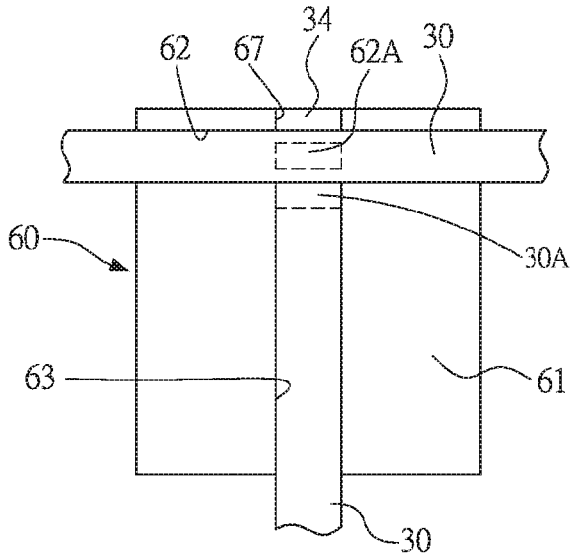
FIG. 18 illustrates an assembled top view of the side base member and the connecting bar of the fourth embodiment.
Figure 19:
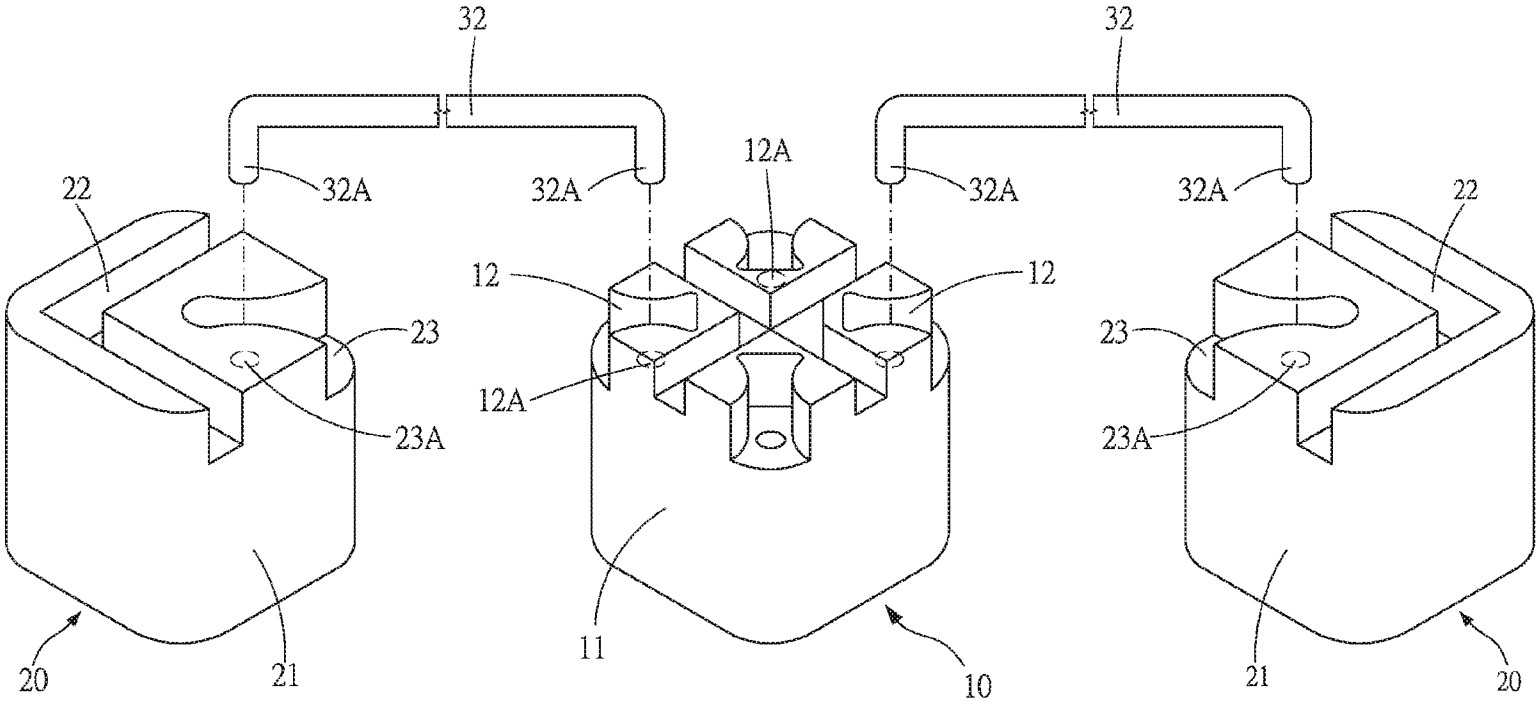
FIG. 19 illustrates an exploded view of the central base member and the slanted connecting bar of the fourth embodiment.

Please refer to FIGS. 9 to 13, which illustrate an assemblable pallet 1 according to a third embodiment of the instant disclosure. In the third embodiment, the pallet frame 2 further comprises standing bars and standing grooves. In this embodiment, the pallet frame 2 comprises standing bars 34 each connected to the side portion of the connecting bar 30. In addition, the standing bar 34 is substantially perpendicular to the connecting bar 30 to form a T-shaped joint structure, as shown in FIG. 10. The main base member 20 comprises a standing groove 27 at the side portion of the main fixing groove 22. In addition, the length direction of the standing groove 27 is substantially perpendicular to the length direction of the main fixing groove 22. When the connecting bar 30 is held in the main fixing groove 22 of the main base member 20, the standing bar 34 is held in the standing groove 27, so that the structural strength between the connecting bar 30 and the main base member 20 can be further improved. In addition, the side base member 60 comprises a standing groove 67 at the side portion of the side fixing groove 62. When the connecting bar 30 is held in the side fixing groove 62 of the side base member 60, the standing bar 34 is held in the standing groove 67, so that the structural strength between the connecting bar 30 and the side base member 60 can be further improved.

As mentioned above, the main base member 20 comprises the standing groove 27, and the side base member 60 comprises the standing groove 67, but embodiments are not limited thereto. In fact, the central base member 10, the main base member 20, or the side base member 60 can freely comprise the standing groove for positioning the standing bar 34. In some embodiments, the connection between the connecting bars 30, 32 can be further soldered to improve the structural strength of the pallet frame 2 and the assemblable pallet 1.

Please refer to FIGS. 14 to 19, which illustrate an assemblable pallet 1 according to a fourth embodiment of the instant disclosure. In the fourth embodiment, the connecting bar 30 is bent and its bent portion can be inserted into the base members. In this embodiment, the connecting bar 30 further comprises two bent portions 30A at two ends thereof. Here, the connecting bar 30 is shaped like a widen U-shaped structure. The main base member 20 further comprises a main inserting hole 22A in the main fixing groove 22, and the depth of the main inserting hole 22A is greater than the depth of the main fixing groove 22. In assembly, the two bent portions 30A of the connecting bar 30 are inserted into two main inserting holes 22A of two main base members 20, so that the two main base members 20 can be connected with each other via the connecting bar 30. In addition, the side base member 60 comprises a side inserting hole 62A for the insertion of the bent portion 30A, so that the main base member 20 and the side base member 60 can be connected with each other via the connecting bar 30.

Figure 25:
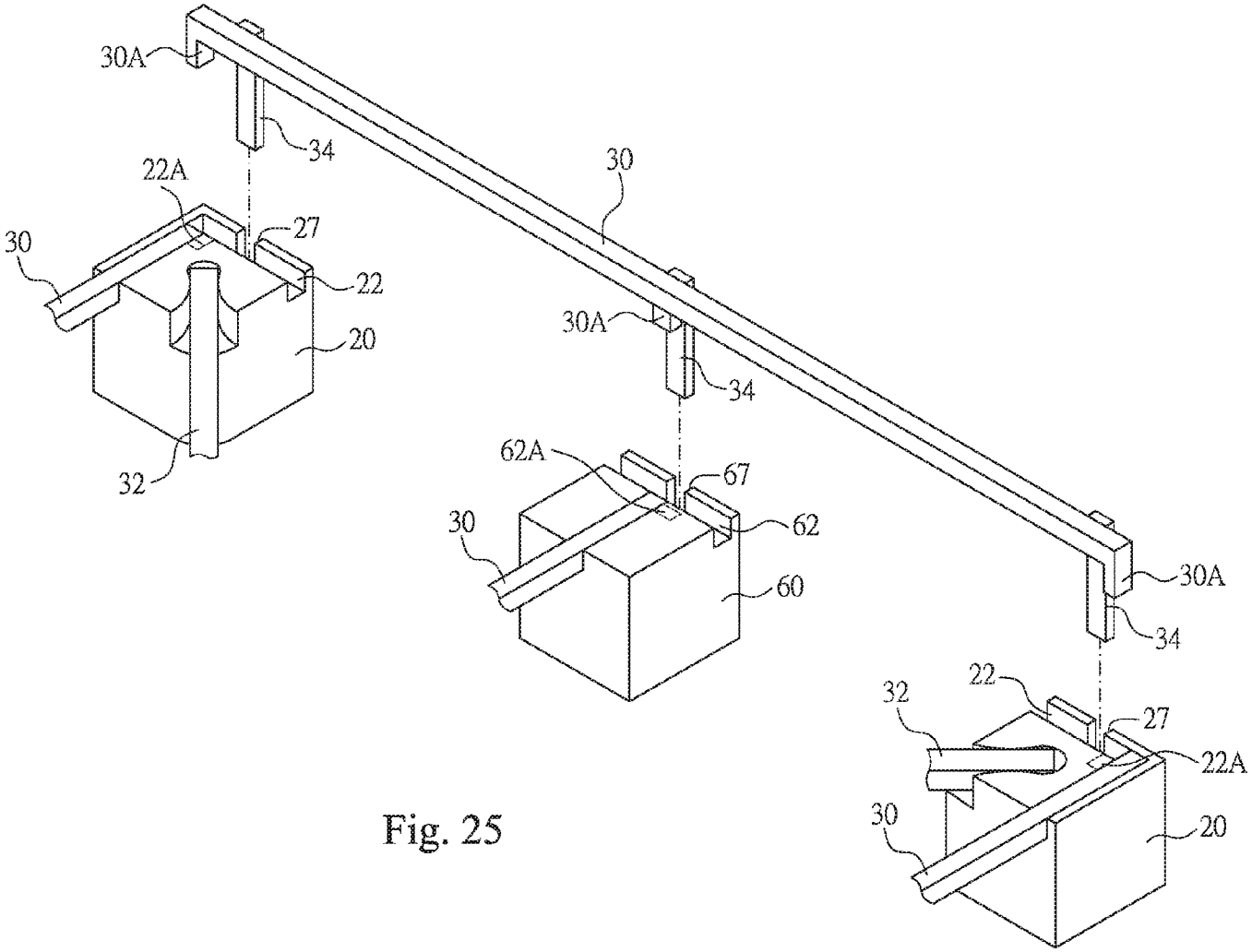
FIG. 25 illustrates an exploded view of one embodiment of an exploded view of the main base member, the side base member, and the connecting bar of the fourth embodiment.
Figure 26:
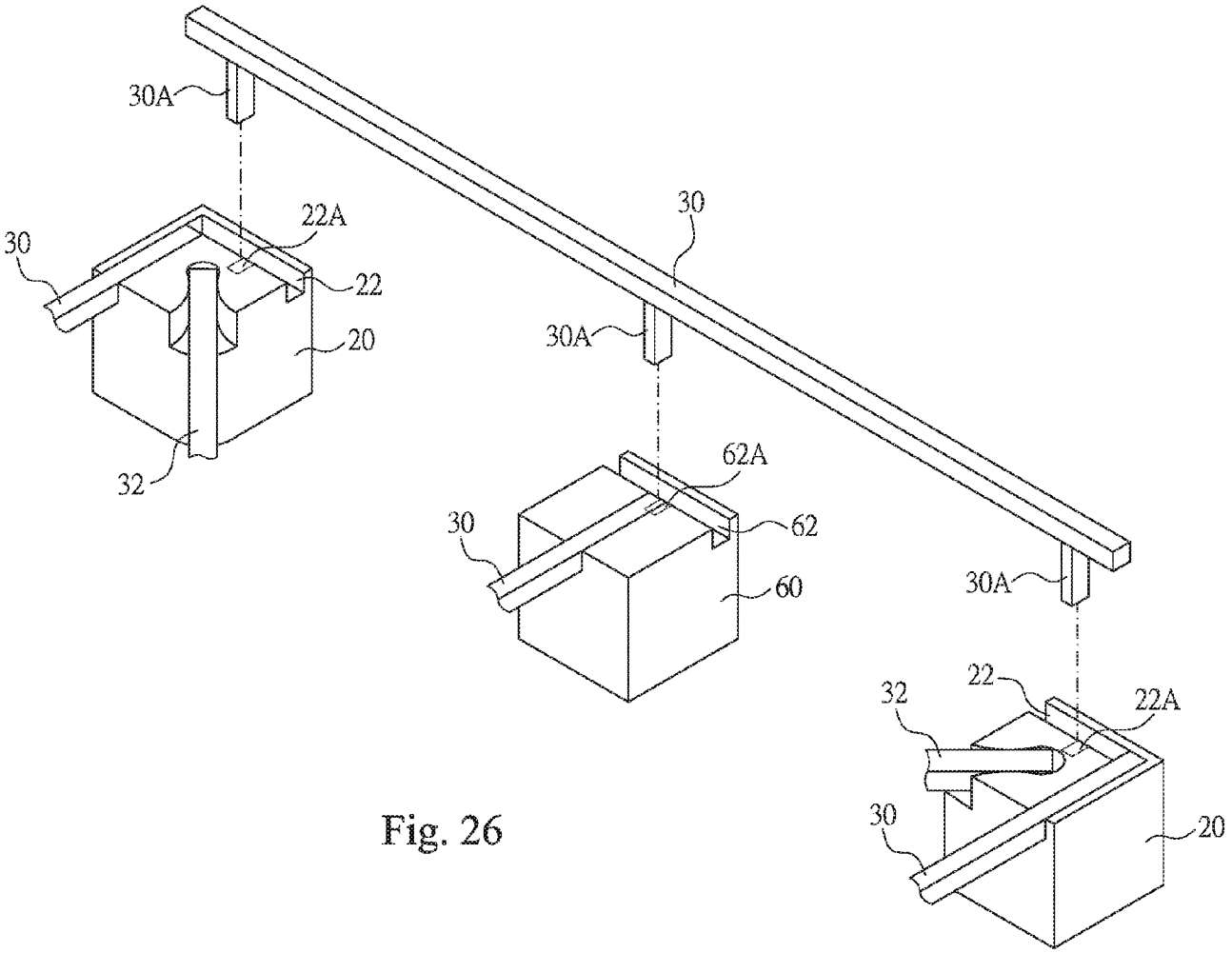
FIG. 26 illustrates an exploded view (1) of another embodiment of an exploded view of the main base member, the side base member, and the connecting bar of the fourth embodiment.

As shown in FIG. 25, in this embodiment, two main base members 20 and one side base member 60 are connected with each other via one connecting bar 30. The connecting bar 30 further comprises a bent portion 30A at the middle portion thereof, and the bent portion 30A can be inserted into the side inserting hole 62A of the side base member 60. Hence, the bent portions 30A at two ends of the connecting bar 30 are respectively inserted into the two main inserting holes 62A of the two main base members 20 and the bent portion 30A at the middle portion of the connecting bar 30 is inserted into the side inserting hole 62A of the side base member 60. Therefore, the two main base members 20 and the one side base member 60 can be connected with each other via the one connecting bar 30. In addition, the connecting bar 30 may be used with the standing bar 34 and the vertical connection portion 30A. Alternatively, as shown in FIG. 26, the vertical connection portion 30A may be provided at any portion of the connecting bar 30 according to practical requirements.

Figure 27:
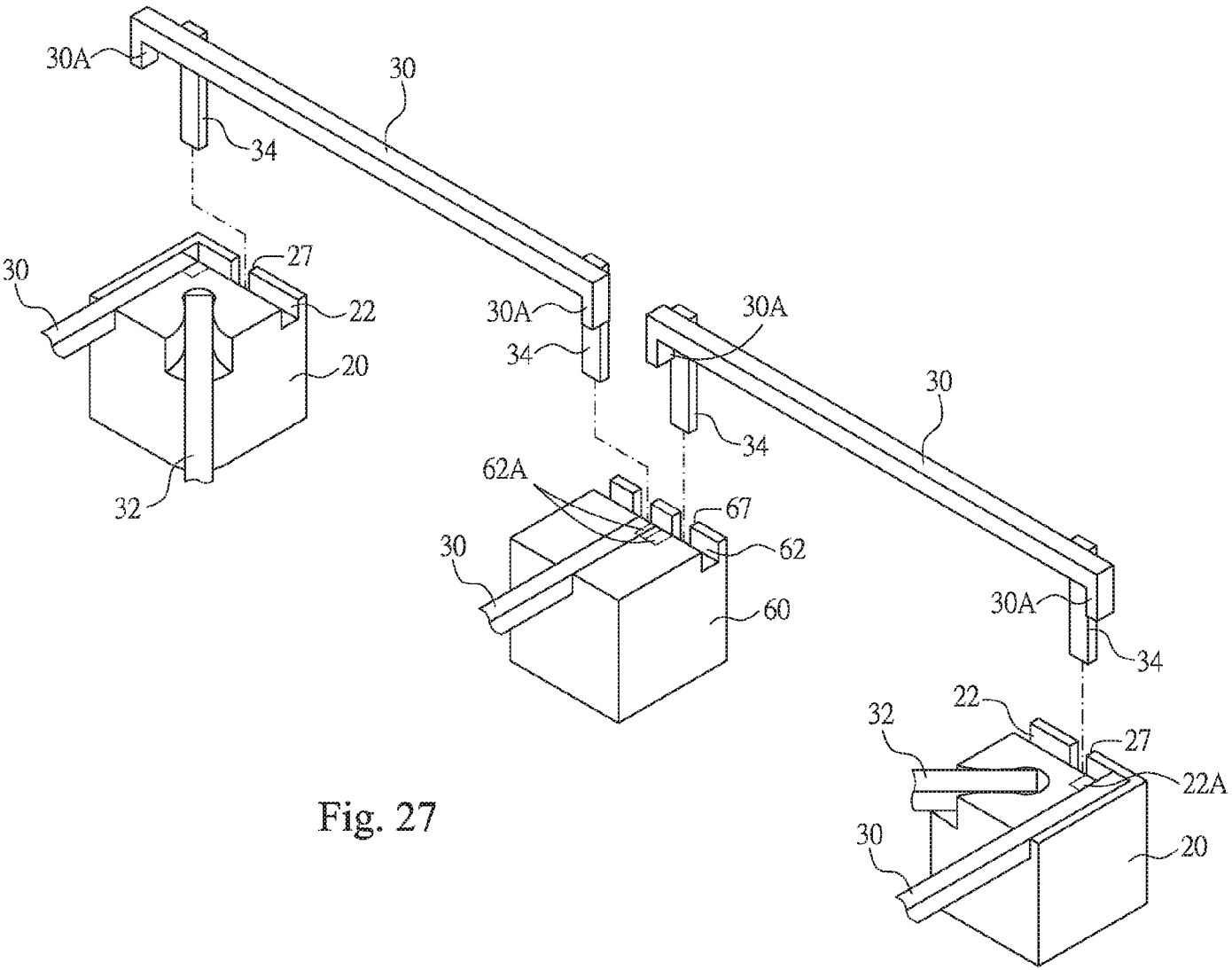
FIG. 27 illustrates an exploded view (2) of another embodiment of an exploded view of the main base member, the side base member, and the connecting bar of the fourth embodiment.

As shown in FIG. 27, in some embodiments, the side base member 60 can be connected with the two main base members 20 via two connecting bars 30. Each of the connecting bars 30 comprises two bent portions 30A at two ends thereof. Each of the side base members 60 comprises a plurality of side inserting holes 62A in the side fixing groove 62. The adjacent two bent portions 30A of the two connecting bars 30 are respectively inserted into the side inserting holes 62A of the side base member 60, and the distant two bent portions 30A of the two connecting bars 30 are respectively inserted into the main inserting holes 22A of the two main base members 20. Therefore, the side base member 60 can be connected with the two main base members 20 via two connecting bars 30.

As shown in FIGS. 14, 15, 16, and 19, the slanted connecting bar 32 further comprises two bent portions 32A at two ends thereof. Here, the slanted connecting bar 32 is shaped like a widen U-shaped structure. The main base member 20 further comprises a main inserting hole 23A in the main angled slot 23, and the central base member 10 further comprises a central inserting hole 12A in the central angled slot 12. In assembly, the bent portions 32A are inserted into the main inserting hole 23A and the central inserting hole 12A, so that the central base member 10 and the main base member 20 can be connected and positioned by the slanted connecting bar 32.

Figure 20:
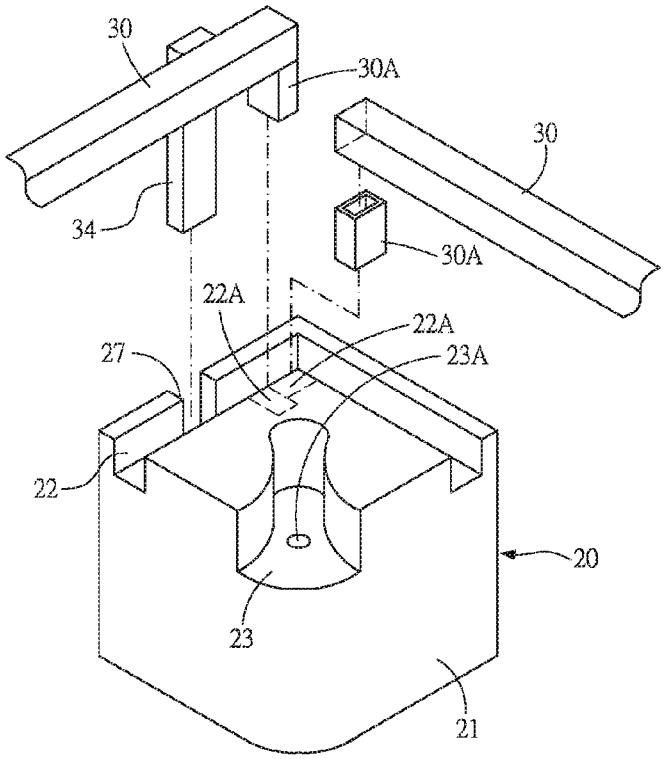
FIG. 20 illustrates an exploded view of another embodiment of the main base member and the vertical connection portions of the connecting bar.
Figure 21:
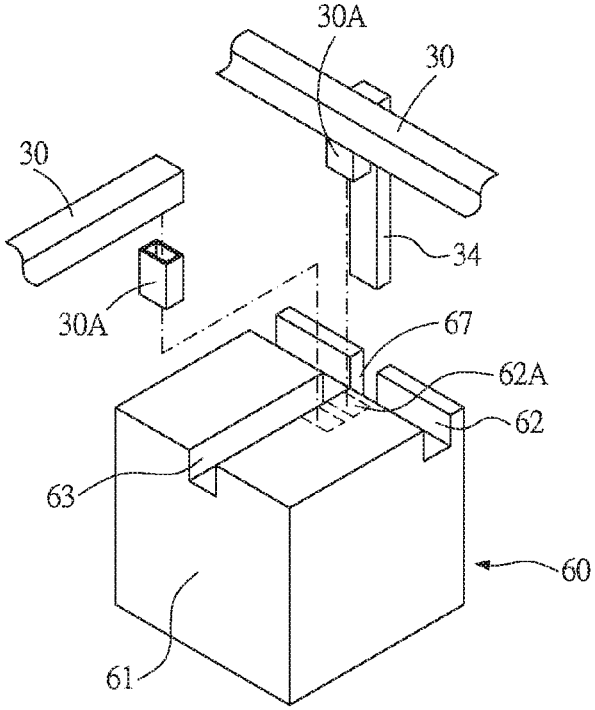
FIG. 21 illustrates an exploded view of another embodiment of the side base member and the vertical connection portions of the connecting bar.
Figure 22:
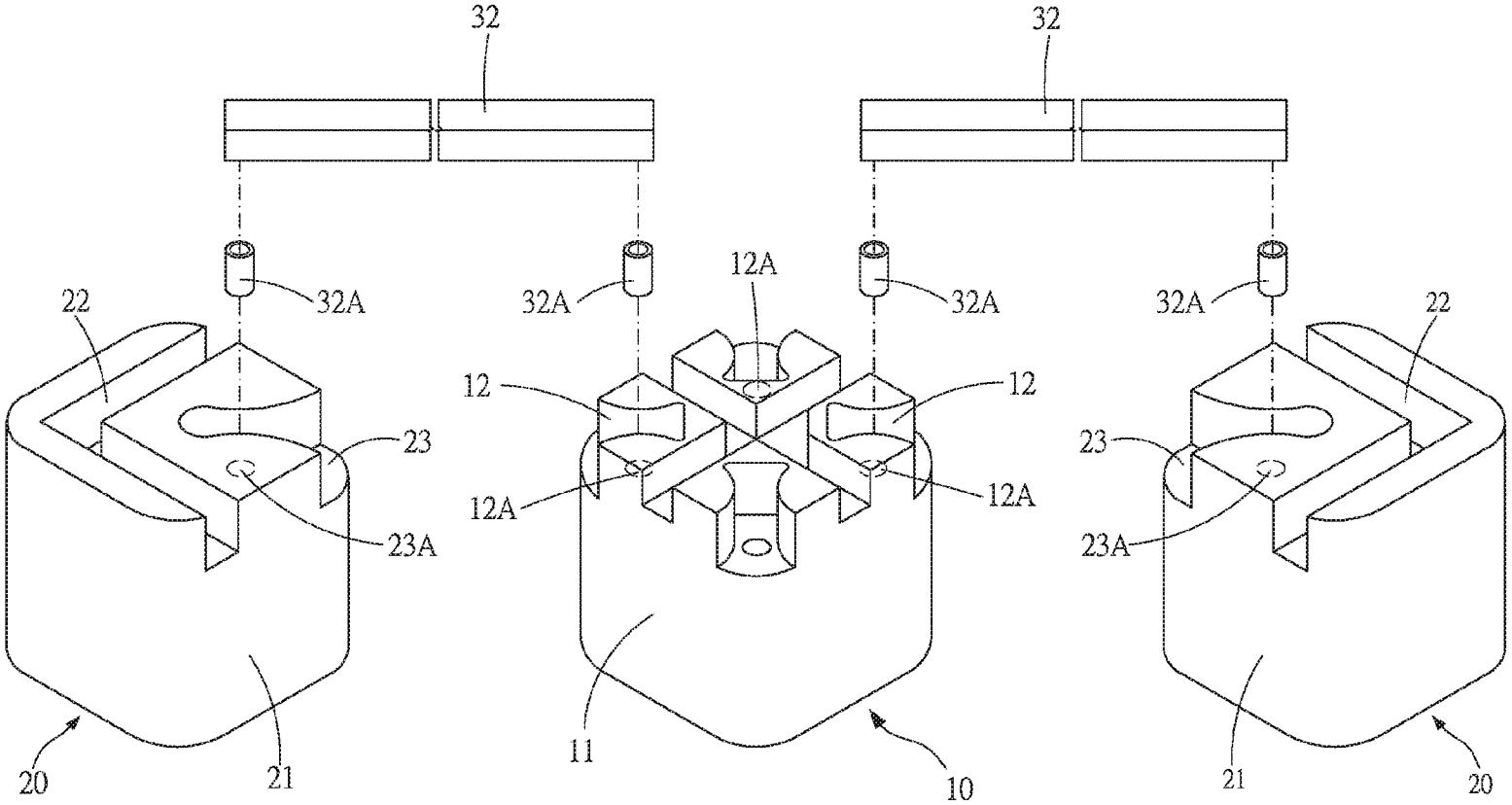
FIG. 22 illustrates an exploded view of another embodiment of the central base member and the vertical connection portion of the slanted connecting bar.

As shown in FIGS. 15 to 19, in the fourth embodiment, the connecting bar 30 and its two vertical connection portions 30A are integrally formed as a whole, and the slanted connecting bar 32 and its two vertical connection portions 32A are integrally formed as a whole, but embodiments are not limited thereto. In some embodiments, as shown in FIGS. 20 and 21, the connecting bar 30 and the two vertical connection portions 30A are separated pieces. The vertical connection portions 30A are respectively fixed at two ends of the connecting bar 30 by soldering. Conversely, as shown in FIG. 22, the slanted connecting bar 32 and the two vertical connection portions 32A are separated pieces. The vertical connection portions 32A are respectively fixed at two ends of the slanted connecting bar 32 by soldering.

Figure 23:
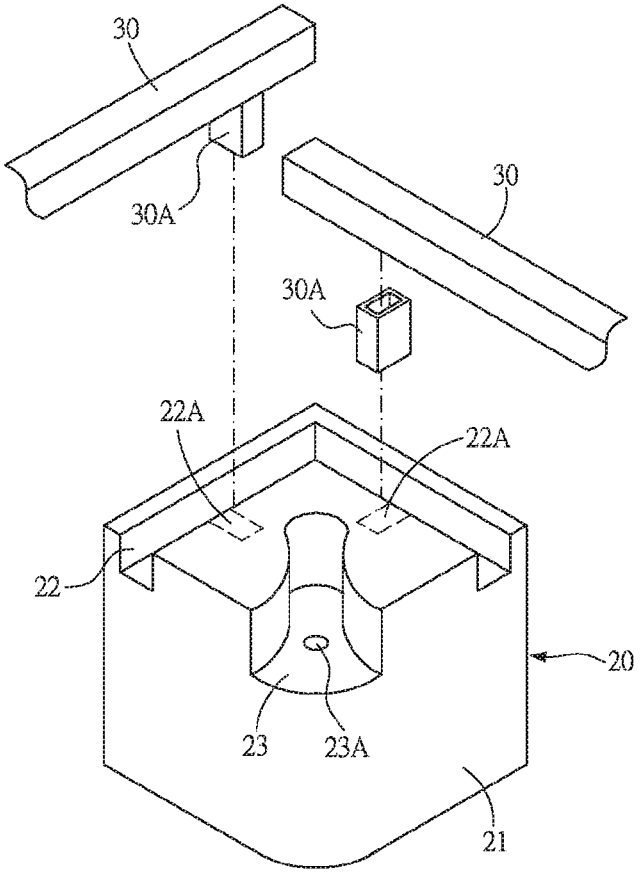
FIG. 23 illustrates an exploded view of yet another embodiment of the central base member and the connecting bar.
Figure 24:
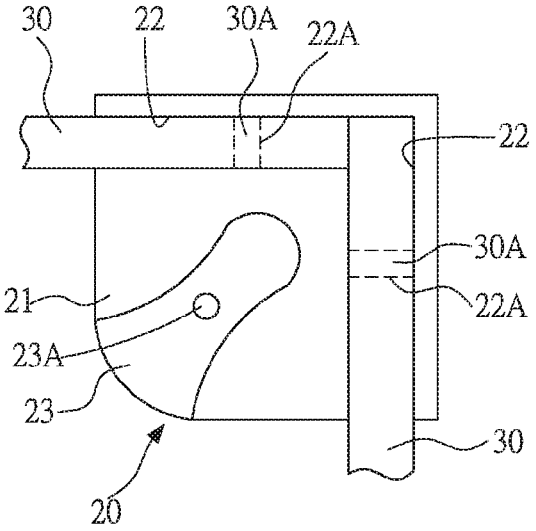
FIG. 24 illustrates a top assembled view of yet another embodiment of the central based member and the connecting bar.

As shown in FIGS. 20 and 21, the vertical connection portions 30A are soldered at the end portions of the two ends of the connecting bar 30, respectively, but embodiments are not limited thereto. In some embodiments, as shown in FIGS. 23 and 24, the vertical connection portion 30A is soldered at a portion of the connecting bar 30 which is spaced from the end portion of the connecting bar 30. The position of the main inserting hole 22A of the main base member 20 corresponds to the position of the vertical connection portion 30A. Therefore, the vertical connection portion 30A can be inserted into the main inserting hole 22A, so that two main base members 20 can be connected with each other via one connecting bar 30.

As shown in FIGS. 20 and 23, it is understood that, the connecting bar 30 may be used solely along with the standing bar 34, solely along with the vertical connection portions 30A, or the connecting bar 30 may also be used along with both the standing bar 34 and the vertical connection portions 30A. In the case that the connecting bar 30 is used along with the standing bar 34, the main base members 20 can be connected and positioned with each other via the connecting bar 30; the reduction of the vertical connection portions 30A reduces the cost of the assemblable pallet 1. In addition, in the case that the connecting bar 30 is used along with the vertical connection portions 30A, the vertical connection portion 30A can be soldered at any portion of the connecting bar 30. For example, as shown in FIG. 20, the vertical connection portions 30A are soldered at two ends of the bottom surface of the connecting bar 30, but embodiments are not limited thereto. In some embodiments, the vertical connection portions 30A are soldered at the side portion of the connecting bar 30, and the position of the vertical connection portion 30A corresponds to the position of the main inserting hole 22A. Therefore, the vertical connection portion 30A can be inserted into the main inserting hole 22A to provide a supporting function for the pallet frame 2.

Figure 28:
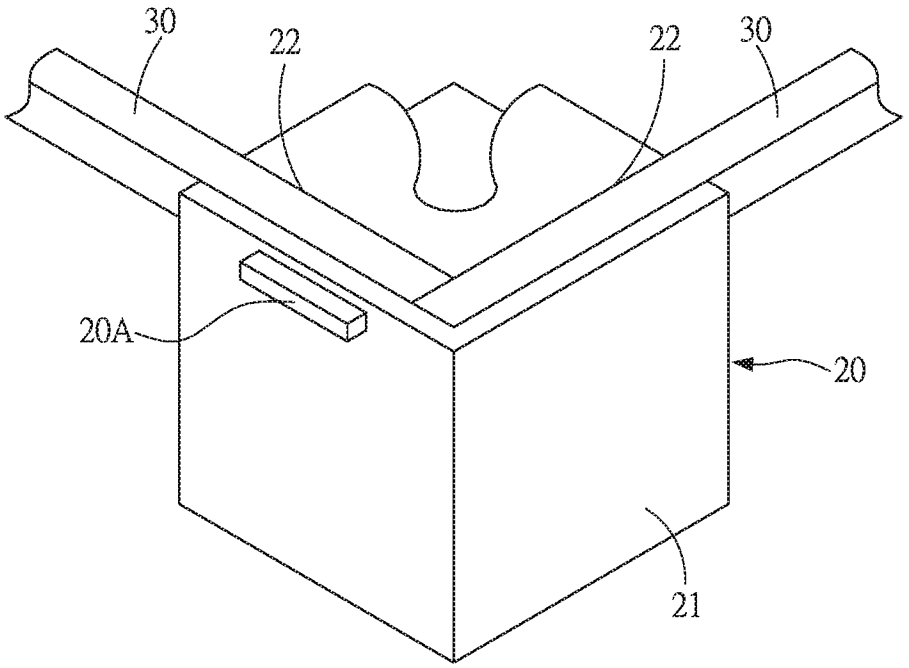
FIG. 28 illustrates a perspective view of a main base member having a protection bar according to an exemplary embodiment of the instant disclosure.
Figure 29:
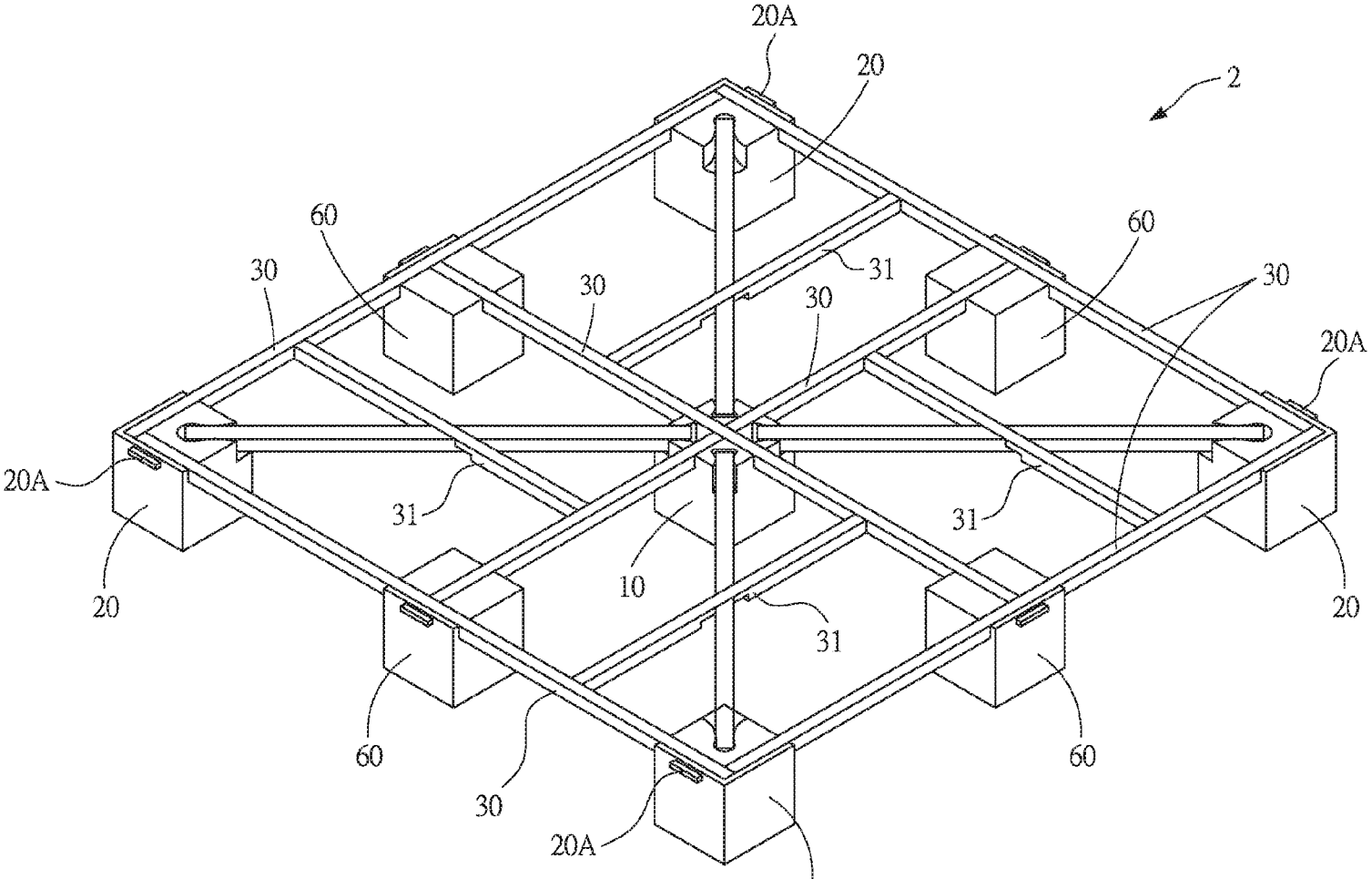
FIG. 29 illustrates a perspective view of a pallet frame having an auxiliary connecting bar according to an exemplary embodiment of the instant disclosure.

In addition, each of the base members may have protection bar 20A. As shown in FIGS. 28 and 29, a protection bar 20A may be extending from one side of the main base member 20. Wherein, the protection bar 20A is a protruded structure for buffering external impacts.

As shown in FIGS. 28 and 29, the pallet frame 2 may further comprise an auxiliary connecting bar 31 for connecting two connecting bars 30. Here, the length direction of the auxiliary connecting bar 31 is substantially perpendicular to the length directions of the two connecting bars 30 and the auxiliary connecting 31 is soldered with the two connecting bars 30, so that the two connecting bars 30 and the auxiliary connecting bar 31 form an H-shaped structure. According, the structural strength of the pallet frame 2 can be improved because of the auxiliary connecting bar 31.

Accordingly, the orientation of the connecting bar can be adjusted because of the structures of the main angled slot and the central angled slot. Hence, the main base members and the central base member can be connected with each other by connecting bars with different lengths, so that the distance between each of the main base members and the central base member can be adjusted. Therefore, the length and the width of the assemblable pallet can be adjusted freely according to practical requirements. In addition, the connecting bars can be connected with the standing bars or the vertical connection portion by soldering arts to improve the overall structural strength on crashworthiness. In addition, the connections between the connecting bars, the standing bars, and the connection portions can be achieved by soldering, so that the metal bars form a metal frame, and the base members can be assembled with the metal frame to form the pallet frame. Based on this, because the assembable pallet is formed by the combination of the metal connecting bars, the plastic base members, and the loading plates, for an assemblable pallet with any size, when a main base member or a central base member is impacted to be damaged, the damaged base member can be replaced by a new base member. Hence, the cost for the assembable pallet can be reduced and the usage rate of the assemblable pallet can be improved.

While the disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An assemblable pallet, comprising:

a pallet frame, comprising:

a central base member made by plastic molding comprising a central base body and a plurality of central angled slots formed on the central base body, wherein the central angled slots are arranged symmetrically about a center of the central base body and intersected with each other, wherein each of the central angled slots comprises, along a direction toward the center of the central base body, a central exterior expanding section, a central abutting portion, and a central interior expanding section;

a plurality of main base members made by plastic molding located symmetrically about the central base member, wherein each of the main base members comprises a main base body, a main fixing groove, and a main angled slot, wherein the main fixing groove and the main angled slot are formed on the main base body, wherein each of the main angled slots comprises, along a direction toward a corner of the corresponding main base body, a main exterior expanding section, a main abutting portion, and a main interior expanding section;

a plurality of connecting bars made of metal held in the main fixing grooves, wherein two ends of each of the connecting bars are respectively connected with the other two adjacent connecting bars to form a metal frame and are held in the main fixing grooves to be abutted against inner walls of the main fixing grooves; and a plurality of slanted connecting bars held in the main angled slots and the central angled slots to position with the central base member and the main base members, wherein the slanted connecting bars are positionally restricted by the main angled slots and the central angled slots; and a loading plate, fixed on the pallet frame.

2. The assemblable pallet according to claim 1, wherein each of the central angled slots and the corresponding main angled slot are extending along the same line.

3. The assemblable pallet according to claim 1, wherein the width of the central abutting portion is less than the width of the central exterior expanding section and the width of the central interior expanding section, and wherein the width of the main abutting portion is less than the width of the main exterior expanding section and the width of the main interior expanding section.

4. The assemblable pallet according to claim 1, wherein the main exterior expanding section comprises two exterior arc surfaces at two sides thereof, the main abutting portion comprises two abutting surfaces, the main interior expanding section comprises two interior arc surfaces at two sides thereof, and wherein the interior arc surface, the abutting surface, and the exterior arc surface at the same side form an convex arc surface.

5. The assemblable pallet according to claim 4, wherein the curvature of each of the interior arc surfaces and the curvature of the corresponding exterior arc surface are the same.

6. The assemblable pallet according to claim 4, wherein for the interior arc surface and the exterior arc surface at the same side, the projection distance from the end portion of the interior arc surface to the corresponding slanted connecting bar is inversely proportional to the projection distance from the end portion of the exterior arc surface to the same slanted connecting bar.

7. The assemblable pallet according to claim 4, wherein for each of the main base members, the distance between the exterior arc surfaces is greater than the distance between the interior arc surfaces.

8. The assemblable pallet according to claim 1, further comprising a plurality of side base members respectively located at the periphery of the central base member and between the main base members, each of the side base members comprises a side base body, a side fixing groove, and a side slot, the side fixing groove and the side slot are formed on the side base body, wherein the central base member comprises a plurality of central slots intersected with the central angled slots, and wherein the connecting bars are further held in the side fixing grooves, the side slots, and the central slots.

9. The assemblable pallet according to claim 8, wherein each of the side fixing grooves is substantially perpendicular to the corresponding side slot, and wherein the central slots are in communication with each other.

10. The assemblable pallet according to claim 1, wherein the loading plate is fixed on the pallet frame by means of gluing, heat sealing, or locking.

11. The assemblable pallet according to claim 1, wherein each of the main base members further comprises a standing groove at the side portion of the main fixing groove, the length direction of the standing groove is substantially perpendicular to the length direction of the main fixing groove, wherein the pallet frame further comprises a standing bar at the side portion of the connecting bar, and wherein when the connecting bar is held in the main fixing groove of the main base member, the standing bar is held in the standing groove.

12. The assemblable pallet according to claim 1, wherein two bent portions are respectively extending from two ends of each of the connecting bars, each of the main base members comprises a main inserting hole in the main fixing groove, the two bent portions are respectively inserted into two main inserting holes of two main base members, so that the two main base members are connected with each other via the connecting bar.

13. The assemblable pallet according to claim 8, wherein three bent portions are respectively extending from two ends and the middle portion of each of the connecting bars, each of the main base members comprises a main inserting hole in the main fixing groove, each of the side base members comprises a side inserting hole in the side fixing groove, the three bent portions are respectively inserted into the main inserting holes and the side inserting holes, so that the main base members and the side base member are connected with each other via the connecting bar.

14. The assembable pallet according to claim 8, wherein two bent portions are respectively extending from two ends of each of the connecting bar, each of the main base members comprises a main inserting hole in the main fixing groove, each of the side base members comprises a plurality of side inserting holes in the side fixing groove, four bent portions of two connecting bars are respectively inserted into the main inserting holes and the side inserting holes, so that the main base members and the side base member are connected with each other via the two connecting bars.

15. The assemblable pallet according to claim 1, wherein two bent portions are respectively extending from two ends of each of the slanted connecting bars, each of the main base members comprises a main inserting hole in the main angled slot, the central base member comprises a central inserting hole in the central angled slot, the two bent portions are respectively inserted into the main inserting hole of the main base member and the central inserting hole of the central base member, so that the main base member and the central base member are connected with each other via the slanted connecting bar.

16. The assemblable pallet according to claim 1, wherein the main base member further comprises a protection bar extending from one side thereof, and the protection bar is a protruded structure.

17. The assembable pallet according to claim 1, wherein an auxiliary connecting bar is between two of the connecting bars for connecting the two connecting bars.

* * * * *